US012631018B2

(12) United States Patent
Phan

(10) Patent No.: US 12,631,018 B2
(45) Date of Patent: May 19, 2026

(54) BRACKET SYSTEM FOR ATTACHING A CANTILEVERED PERGOLA TO A ROOF RAFTER

(71) Applicant: Toan Phan, Oakley, CA (US)

(72) Inventor: Toan Phan, Oakley, CA (US)

( * ) Notice: Subject to any disclaimer, the term of this patent is extended or adjusted under 35 U.S.C. 154(b) by 200 days.

(21) Appl. No.: 18/621,410

(22) Filed: Mar. 29, 2024

(65) Prior Publication Data

US 2024/0240449 A1 Jul. 18, 2024

Related U.S. Application Data

(63) Continuation of application No. 18/619,423, filed on Mar. 28, 2024, which is a continuation-in-part of application No. 18/076,901, filed on Dec. 7, 2022, now Pat. No. 12,490,686, which is a continuation-in-part of application No. 17/899,217, filed on Aug. 30, 2022, now Pat. No. 11,566,415.

(51) Int. Cl.

| | |
|---|---|
| ***E04B 1/346*** | (2006.01) |
| ***E04B 1/38*** | (2006.01) |
| ***E04B 1/58*** | (2006.01) |
| ***E04B 7/14*** | (2006.01) |
| ***E04F 10/00*** | (2006.01) |

(52) U.S. Cl.

CPC ..... *E04B 1/388* (2023.08); *E04B 1/5831* (2013.01); *E04B 7/14* (2013.01); *E04F 10/005* (2013.01); *E04B 2001/389* (2023.08); *E04B 2001/5875* (2013.01); *E04B 2001/5887* (2013.01)

(58) Field of Classification Search

CPC ..... E04B 1/388; E04B 7/14; E04B 2001/389; E04B 2001/5875

See application file for complete search history.

(56) References Cited

U.S. PATENT DOCUMENTS

| | | | |
|---|---|---|---|
| 2,037,736 | A | 4/1936 | Payne et al. |
| 2,768,434 | A | 10/1956 | Taylor |
| 2,931,129 | A | 4/1960 | Boniface |
| 3,107,401 | A | 10/1963 | Heirich |
| 3,333,875 | A | 8/1967 | Tracy |
| 3,988,872 | A | 11/1976 | Adamson et al. |

(Continued)

OTHER PUBLICATIONS

International Written Opinion for the corresponding application PCT/US2023/011210, dated Apr. 5, 2023, 10 pages.

(Continued)

*Primary Examiner* — Basil S Katcheves

(74) *Attorney, Agent, or Firm* — Goldstein Law Offices, P.C.

(57) ABSTRACT

A bracket system, for suspending pergola beams from an existing structure, the existing structure having a vertical wall and roof rafters that each have a rafter top and a rafter end that extends beyond the vertical wall over a ground surface, each of the pergola beams having a supported end, including a plurality of brackets. Each bracket having a mounting assembly for attaching to one of the rafters, a support assembly for attaching the support end of one of the pergola beams, and a connecting assembly that suspends the support assembly from the mounting assembly. The pergola beams extend over the ground surface, away from the existing structure, supported only by the bracket at the support end and without any vertical supports.

7 Claims, 34 Drawing Sheets

(56) References Cited

U.S. PATENT DOCUMENTS

| | | | | |
|---|---|---|---|---|
| D248,447 | S | 7/1978 | Hornung | |
| 4,856,252 | A | 8/1989 | Cornell | |
| 5,156,484 | A | 10/1992 | Allen | |
| 5,236,273 | A | 8/1993 | Gilb | |
| 5,299,395 | A | 4/1994 | Smith et al. | |
| 5,526,614 | A | 6/1996 | Huang | |
| 5,966,890 | A | 10/1999 | Inman | |
| 5,975,471 | A | 11/1999 | Dishman | |
| 7,024,825 | B2 * | 4/2006 | Kebeli | E04B 7/045 52/712 |
| 7,475,517 | B2 | 1/2009 | Kawai et al. | |
| 7,739,841 | B1 * | 6/2010 | Puckett | E04C 3/40 52/93.2 |
| 8,720,155 | B1 | 5/2014 | Robell | |
| 9,428,902 | B1 | 8/2016 | LoFranco et al. | |
| 9,605,425 | B1 * | 3/2017 | Hendry | E04B 1/2403 |
| 9,822,524 | B1 | 11/2017 | Mezarich | |
| 10,100,508 | B1 | 10/2018 | Fox | |
| 10,132,074 | B2 | 11/2018 | Pace | |
| 10,167,888 | B2 | 1/2019 | Barker | |
| 10,184,504 | B1 | 1/2019 | Carroll | |
| 10,246,876 | B2 | 4/2019 | Brean | |
| 10,273,678 | B2 * | 4/2019 | Hensen | E04B 1/2608 |
| 10,309,095 | B2 * | 6/2019 | Hildestad | E04D 12/008 |
| 10,358,811 | B1 | 7/2019 | Fox | |
| 10,465,389 | B2 | 11/2019 | Hughes | |
| 10,738,457 | B1 * | 8/2020 | Hendry | E04B 1/1903 |
| 10,745,907 | B1 | 8/2020 | Canby | |
| 10,907,342 | B1 | 2/2021 | Parkhouse et al. | |
| 11,149,431 | B1 | 10/2021 | Meznarich | |
| 11,566,415 | B1 * | 1/2023 | Phan | E04B 1/2612 |
| 2002/0112439 | A1 * | 8/2002 | Rosas | E04B 1/2608 52/715 |
| 2016/0168840 | A1 | 6/2016 | Monty et al. | |
| 2016/0177560 | A1 | 6/2016 | Hensen et al. | |
| 2016/0190974 | A1 | 6/2016 | Dickey et al. | |
| 2017/0298612 | A1 * | 10/2017 | Hildestad | E04D 12/008 |
| 2017/0306612 | A1 * | 10/2017 | Kasprzak | E04B 1/388 |
| 2018/0073240 | A1 | 3/2018 | Meznarich | |
| 2018/0230697 | A1 | 8/2018 | Albert | |
| 2018/0334801 | A1 | 11/2018 | Brean | |
| 2019/0093366 | A1 | 3/2019 | Hughes | |
| 2020/0291643 | A1 | 9/2020 | Marlow | |

OTHER PUBLICATIONS

International Search Report for the corresponding application PCT/US2023/011210, dated Apr. 5, 2023, 10 pages.

* cited by examiner

BRACKET SYSTEM FOR ATTACHING A CANTILEVERED PERGOLA TO A ROOF RAFTER

CROSS-REFERENCE TO RELATED APPLICATIONS

This application is a continuation of non-provisional patent application Ser. No. 18/619,423, filed in the United States Patent Office on Mar. 28, 2024, which is a continuation-in-part of non-provisional patent application, Ser. No. 18/076,901, filed in the United States Patent Office on Dec. 7, 2022, which is a continuation-in-part of non-provisional patent application Ser. No. 17/899,217, filed in the United States Patent Office on Aug. 30, 2022, claims priority therefrom, and is expressly incorporated herein by reference in its entirety.

TECHNICAL FIELD

The present disclosure relates generally to a structural system for attaching a cantilevered pergola or trellis to a dwelling. More particularly, the present disclosure relates to a bracket that allows individual beam members of a pergola to be attached to the roof rafters of the dwelling.

BACKGROUND

Pergolas and trellises are often provided to complement a structure, by providing support for vines and climbing plants, and by providing shade that increases the space that may be comfortably occupied on sunny days.

Trellises can differ in configuration from generally vertical structures to facilitate a rose bush or climbing vine, to those that have overhead beams as commonly found in all pergolas. While there are some technical differences between a trellis and a pergola, both standardly require the support of vertical posts that are secured to the ground surface. Such vertical posts therefore have a footprint that occupies space that might interfere with other uses of that space and may cause a discontinuity in an otherwise open area.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a pergola structure that spans across a ground surface and does not require support from the ground surface. Accordingly, the present disclosure provides a pergola structure that attaches to the roofline of an existing structure and is cantilevered to extend horizontally therefrom.

It is another aspect of an example embodiment in the present disclosure to provide a pergola structure that attaches to existing roof rafters of the structure. Accordingly, a bracket is provided that secures to the roof rafter and supports a pergola beam.

It is yet another aspect of an example embodiment in the present disclosure to provide a bracket that is inexpensive and efficient to manufacture. Accordingly, the bracket may be fabricated from a single piece of material that is cut and bent into a suitable configuration.

Accordingly, the present disclosure describes a bracket system, for suspending pergola beams from an existing structure, the existing structure having a vertical wall and roof rafters that each have a rafter top and a rafter end that extends beyond the vertical wall over a ground surface, each of the pergola beams having a supported end, including a plurality of brackets. Each bracket having a mounting assembly for attaching to one of the rafters, a support assembly for attaching the support end of one of the pergola beams, and a connecting assembly that suspends the support assembly from the mounting assembly. The pergola beams extend over the ground surface, away from the existing structure, supported only by the bracket at the support end and without any vertical supports.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
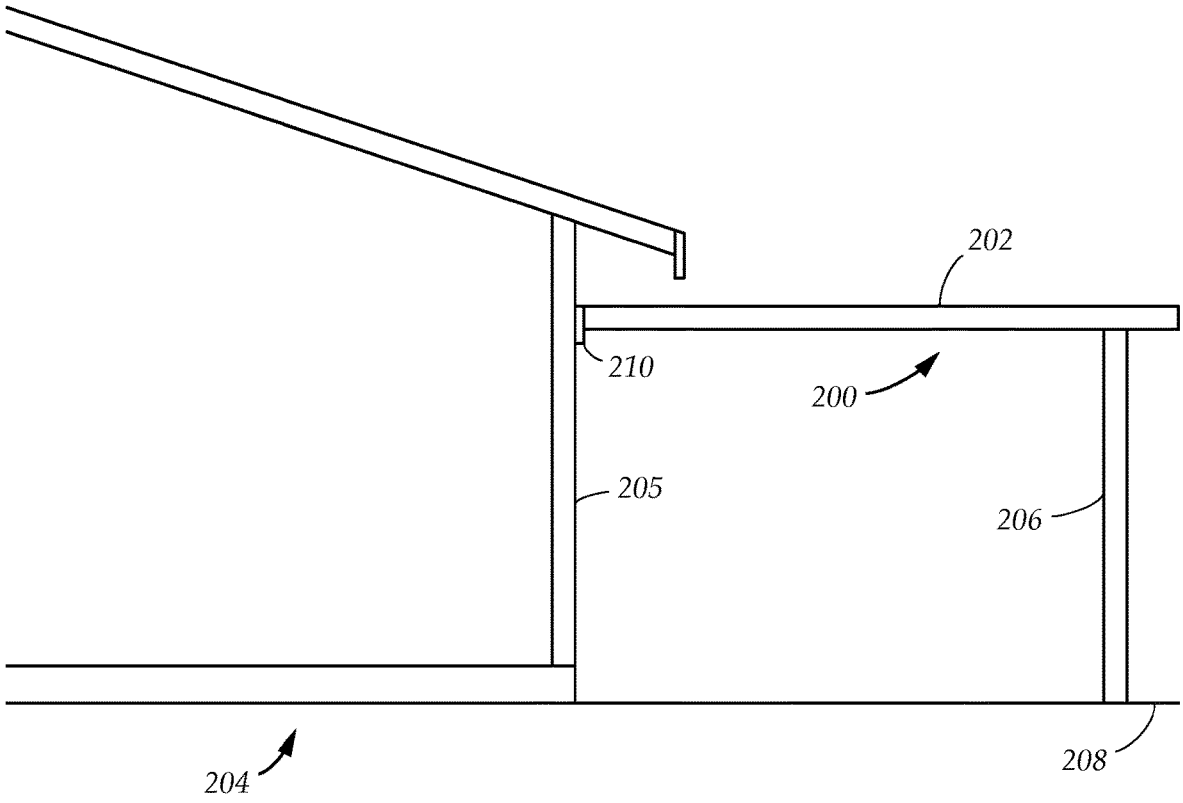
Prior Art FIG. 1
FIG. 1 is a side elevational view, illustrating a prior art example of a pergola structure attached to the side of a dwelling and supported by vertical support posts.

FIG. 1 illustrates a standard pergola 200 as found in the prior art. The standard pergola has a series of horizontal beams 202 that are attached on one end to a dwelling 204, and are supported near an opposite end with at least one vertical post 206, which is itself supported by a ground surface 208. The dwelling 204 has a vertical wall 205, and the horizontal beams 202 are attached to the dwelling 204 by a ledger board 210 that extends horizontally on the vertical wall 205.

Figure 2:
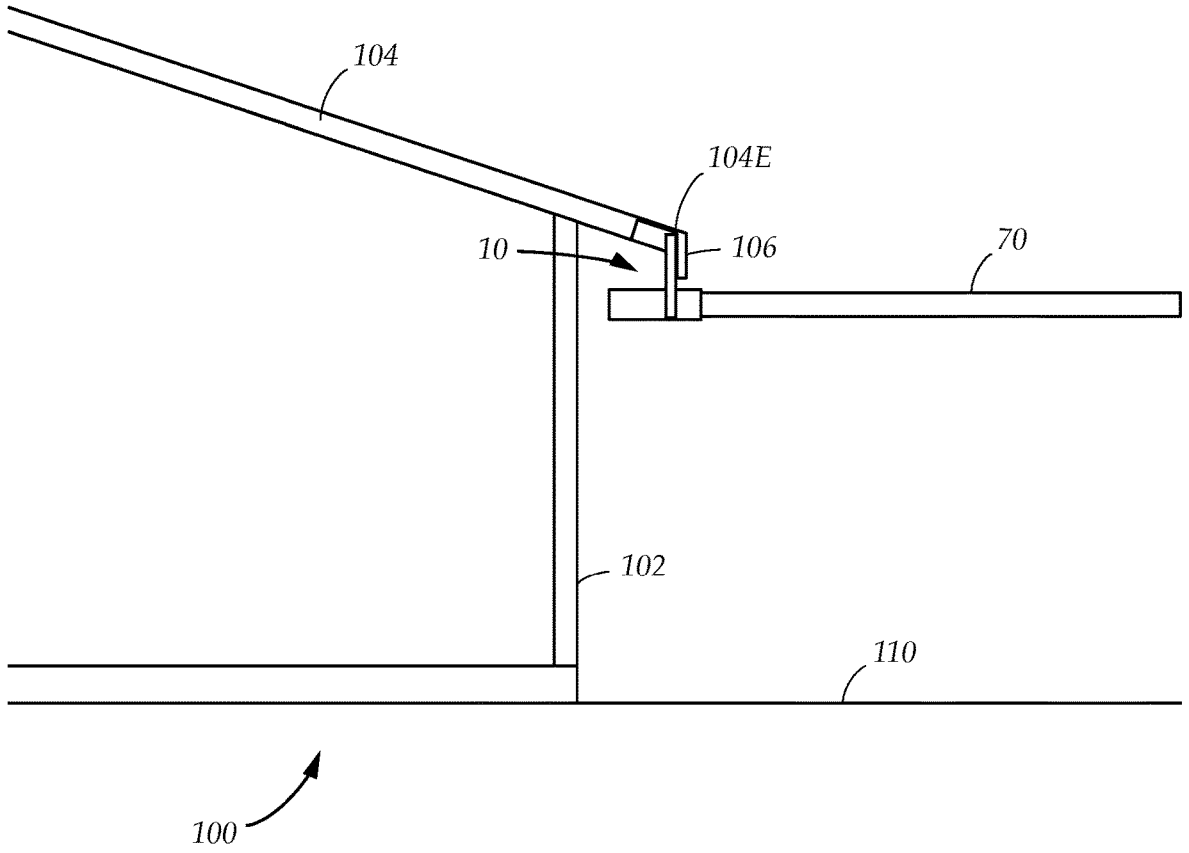
FIG. 2 is a side elevational view, illustrating a pergola structure that is cantilevered from an existing dwelling and supported solely by the roof rafters thereof.

In accordance with the principles of the present disclosure, in FIG. 2 an existing structure 100 Is illustrated, having a vertical wall 102 and a plurality of roof rafters 104 that extend laterally beyond the vertical wall 102, on a downward angle therefrom. The rafters 104 are parallel to each other, as better seen in FIG. 7. Each of the rafters 104 have a rafter end 104E. A fascia board 106 is secured across the rafter ends 104E. A ground surface 110 extends from the vertical wall 102 beneath the roof rafters 104 and horizontally outward for a significant distance beyond the rafter ends 104E. A plurality of brackets 10 are provided to each support a pergola beam 70 such that the pergola beams 70 extend horizontally over the ground surface 110. Each bracket 10 is secured to one of the rafters 104. The pergola beams 70 are solely supported by the brackets 10 and do not require other support. Notably, the brackets 10 allow the pergola beams 70 to extend horizontally over the ground surface 110, while the rafters 104 extend at an acute angle from the pergola beams 70.

Figure 5:
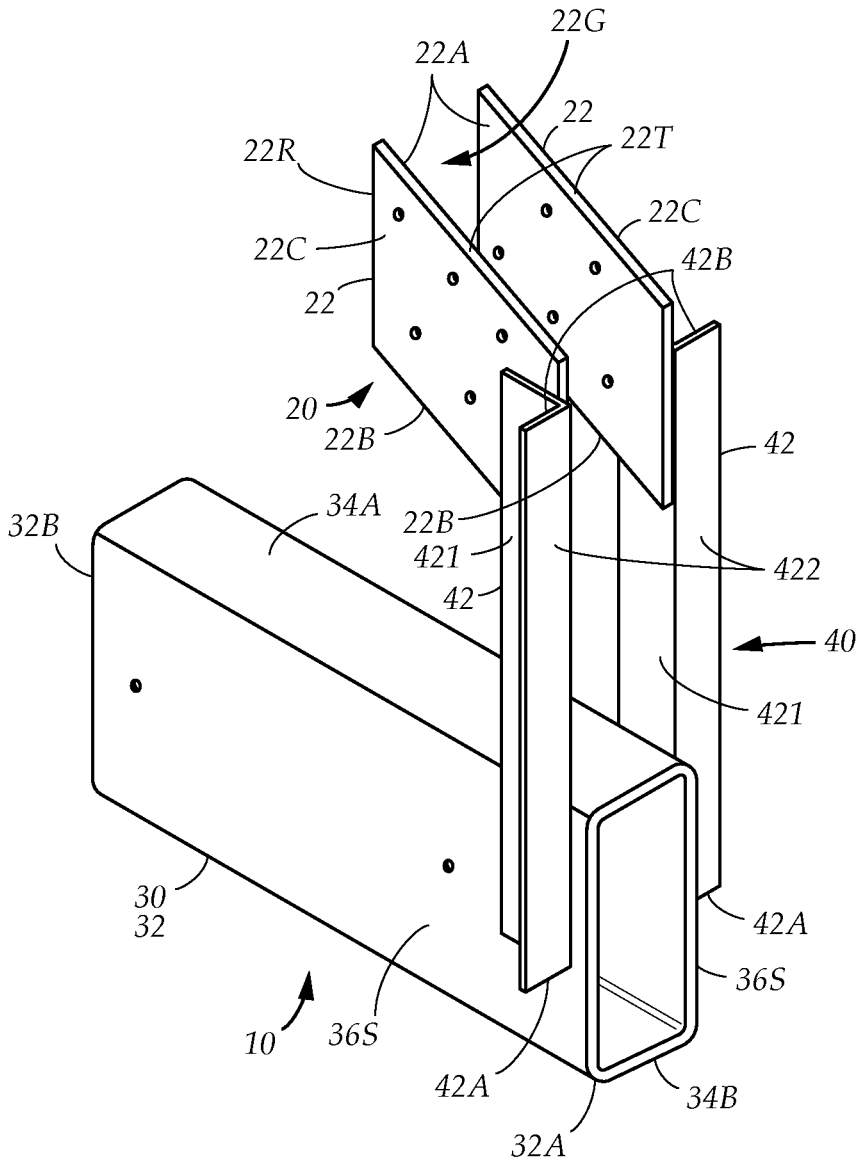
FIG. 5 is a diagrammatic perspective view of just the bracket, per se.

Referring to FIG. 5, the bracket 10 has a mounting assembly 20 that includes a pair of mounting plates 22. The bracket further has a support assembly 30, and a connecting assembly 40 that includes pair of vertical arms 42 to connect the mounting assembly 20 and support assembly 30.

The mounting plates 22 each have an inside surface 22A and an outside surface 22C, top 22T and bottom edges 22B. The mounting plates 22 extend vertically and substantially parallel to each other, with the inside surfaces 22A facing each other. The support assembly 30 has a top and is shown configured as a generally rectangular support tube 32 having an open first end 32A and an open second end 32B. Between the first end and second end are a top plate 34A and a bottom plate 34B, and a pair of side plates 36S. Note that the top plate 34A, bottom plates 34B, and side plates 36S together define the support tube 32, but the support assembly 30 need not take the extruded form illustrated, and may be constructed—for example—of discrete elements for the top plate 34A and bottom plate 34B that are connected by side plates 36S that are not fully continuous between the first end 32A and second end 32B. The vertical arms 42 of the connecting assembly 40 may each be an extruded right angle member having a longitudinal face 421 and a transverse face 422, a first end 42A and a second end 42B. The longitudinal face 421 of each vertical arm 42 is each attached to the side plates 36S near the first end 42A of said vertical arm 42. The longitudinal face 421 of each vertical arm 42 is also attached to the outside surface 22C of one of the mounting plates 22 near the second end 42B of said vertical arm 42. With the top and the top plate 34A of the support assembly 30 extending substantially horizontally, the top 22T and bottom 22B edges of each mounting plate 22 are angled upwardly at an acute angle with respect to horizontal and with respect to the top plate 34A of the support assembly 30.

Figure 6A:
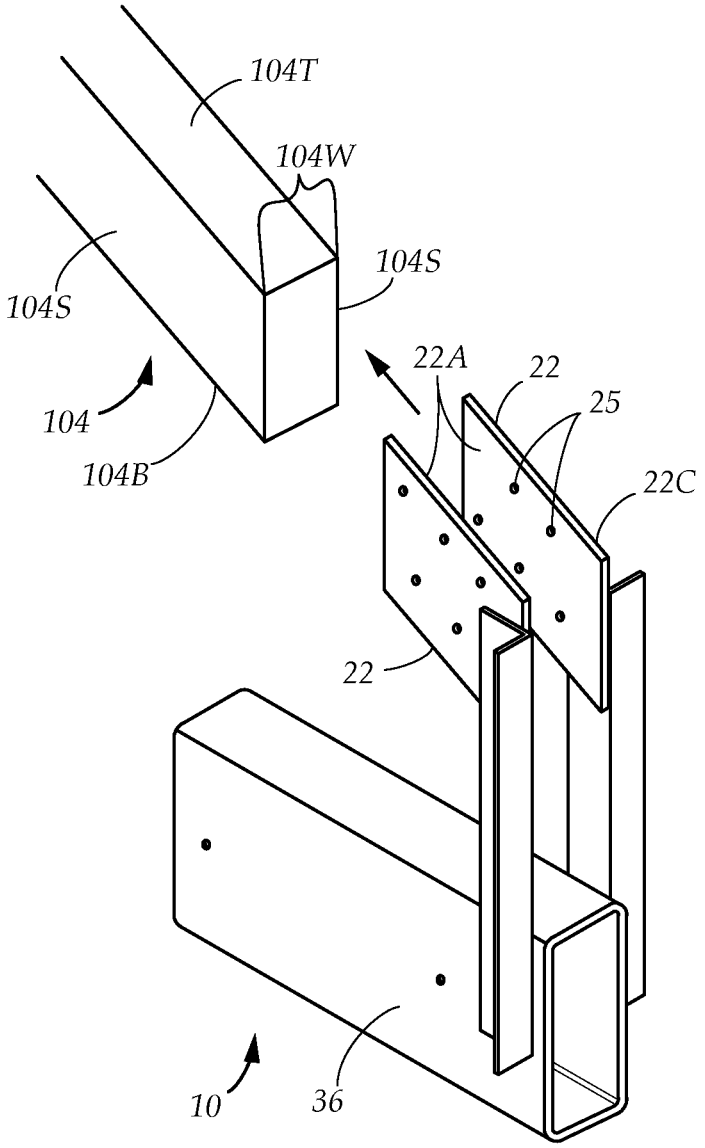
FIG. 6A is a diagrammatic perspective view, illustrating the bracket about to be attached to one of the rafters.

Referring to FIG. 6A, the bracket 10 is generally configured in accordance with dimensions of the roof rafter 104. In particular, the roof rafter 104 has a rafter top 104T, rafter sides 104S, a rafter width 104W, and wherein the inside surfaces 22A of the mounting plates 22 are separated by a distance that is substantially the same as the width 104W of the rafter 104, so that the mounting plates 22 can accommodate the rafter 104 therebetween. Note that the mounting plates 22 have mounting holes 25 that extend fully between the outside surface 22C and inside surface 22A. The mounting holes 25 may be aligned between the two mounting plates 22 to allow fasteners to extend fully therebetween, or alternatively may be offset to allow fasteners to extend from each of the mounting plates 22.

Figure 3:
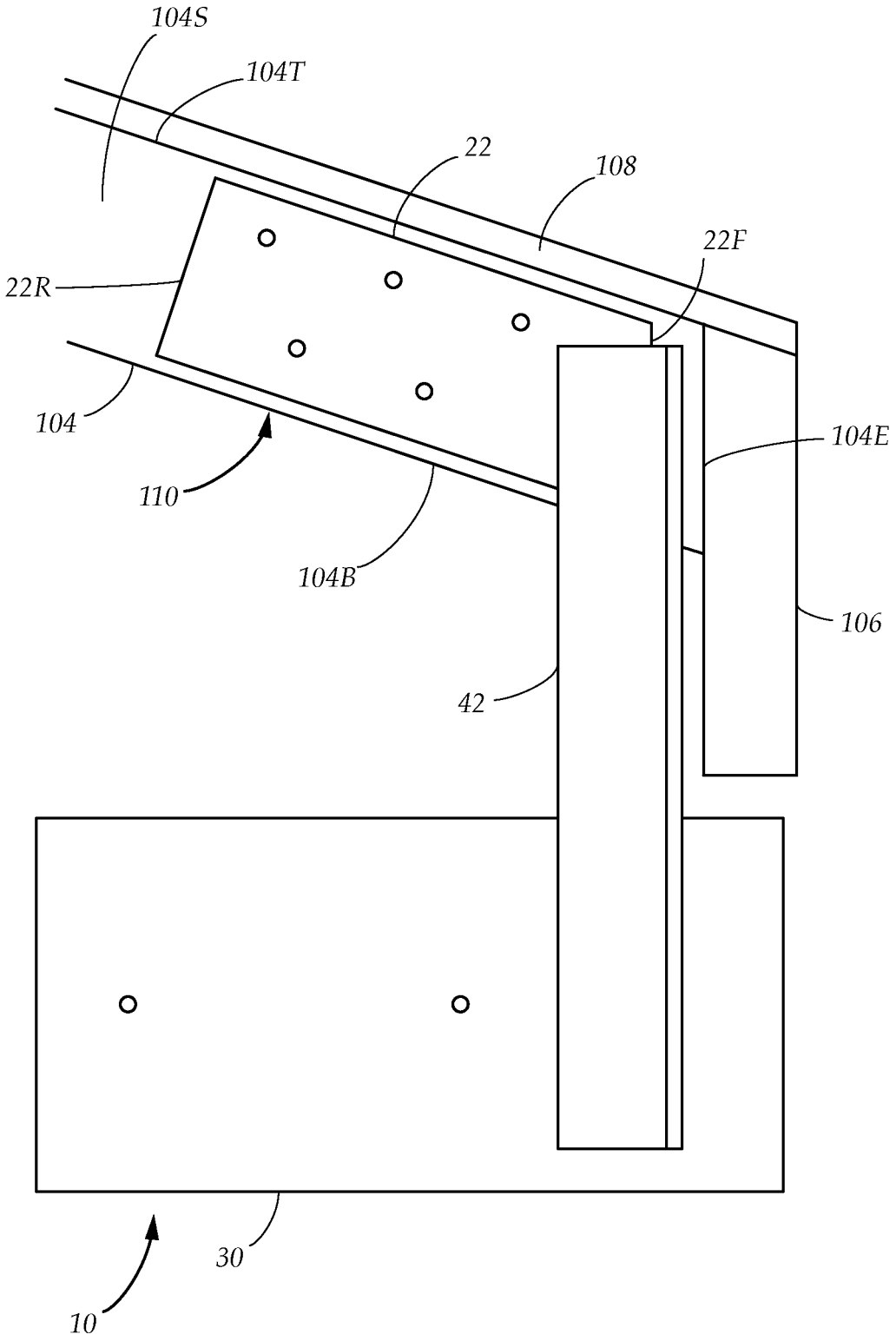
FIG. 3 is a side elevational view, illustrating an embodiment of a bracket as described in detail herein, the bracket attached to a roof rafter near a fascia board.
Figure 6B:
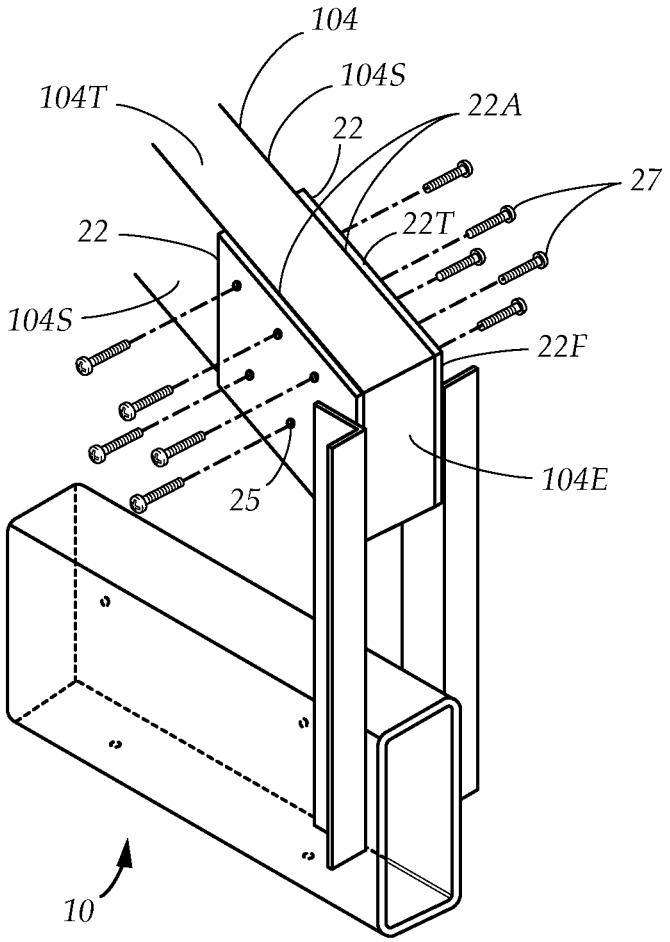
FIG. 6B is a diagrammatic perspective view illustrating the roof rafter extending within the mounting assembly, with mounting fasteners about to secure the mounting assembly to the roof rafter.

Referring to FIG. 6B, the rafter 104 has been fully inserted between the mounting plates 22 and is shown in this example with the rafter end 104E aligned with the front edge 22F of the mounting plates 22, the rafter sides 104S against the inside surfaces 22A of the mounting plates 22, and the rafter top 104T corresponding with the top edge 22T of the mounting plates 22. Mounting fasteners 27, such as screws or bolts, are inserted through the mounting holes 25 in the mounting plates 22 and into the sides 104S of the rafter 104 to secure the rafter 104 to the bracket 10. Note, referring to FIG. 3, when the rafter ends 104E are not exposed, the bracket 10 may be backed off slightly along the rafter 104 a small distance from the rafter end 104E, prior to fastening, such that front edge 22F of the mounting plates 22 are near and extend parallel to the rafter end 104E. This positions the mounting plates 22 and vertical arms 42 interior to the fascia board 106 that is secured across the rafter ends 104E. Note that the vertical arms 42 provide a vertical offset for the support assembly 30, such that the support assembly 30 is positioned below the roofline and below the fascia board 106, to thereby be at the right height for support of the pergola as described next and as will be seen in FIG. 4.

Figure 6C:
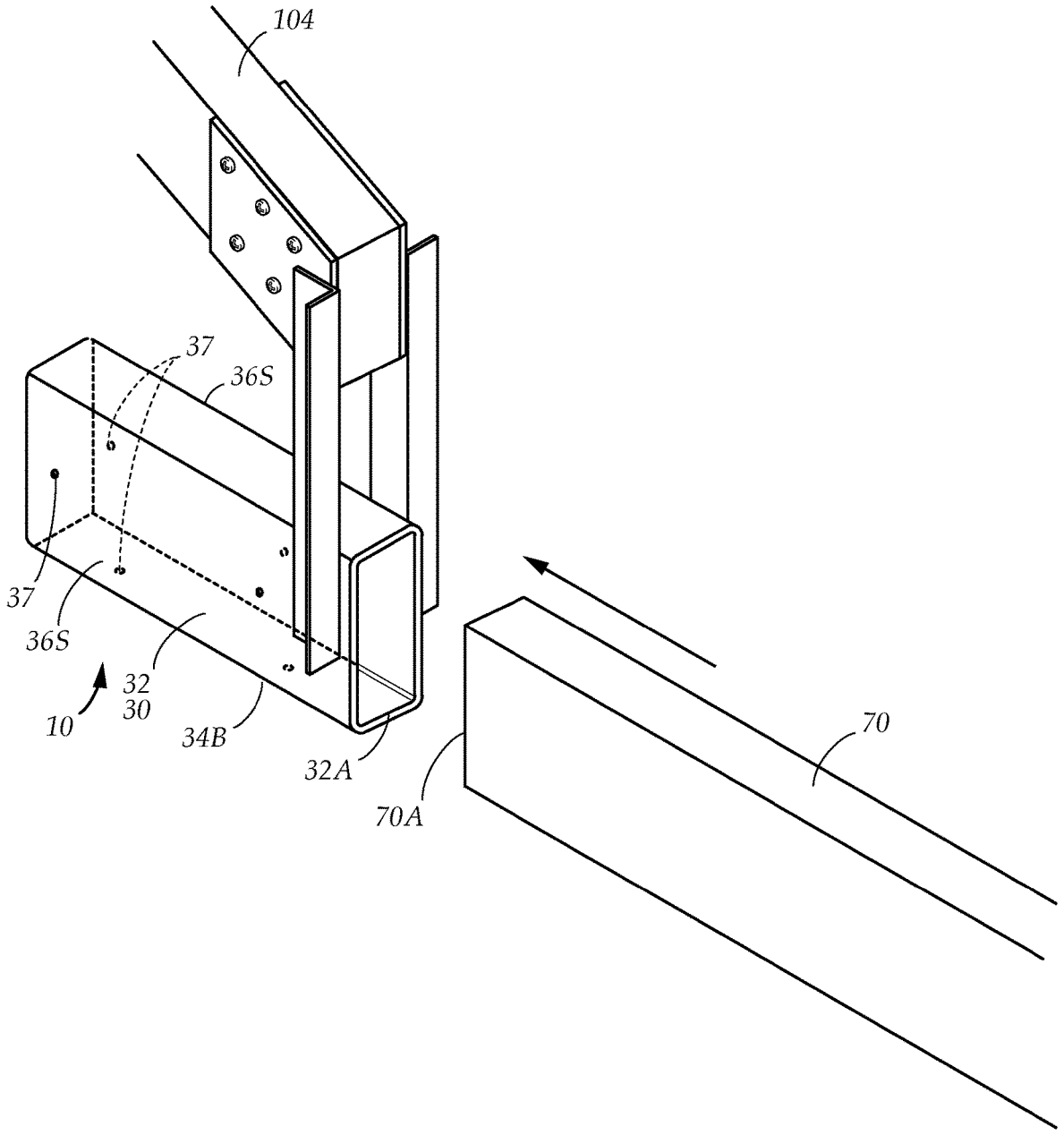
FIG. 6C is a diagrammatic perspective view, illustrating one of the pergola beams about to be inserted into the support assembly.

With the rafter 104 secured to the bracket 10, the pergola beam 70 maybe inserted into the support assembly 30 as shown in FIG. 6C. In particular, the pergola beam 70 has a supported end 70A that is inserted longitudinally into the first open end 32A of the support tube 32 of the support assembly 30. To facilitate a strong structural connection with the pergola beam 70, the side plates 36S and bottom plate 34B of the support assembly 30 have support holes 37 that extend through the side plates 36S. The support holes 37 may be aligned between the side plates 36S to allow fasteners to extend fully therebetween or may be offset.

Figure 4:
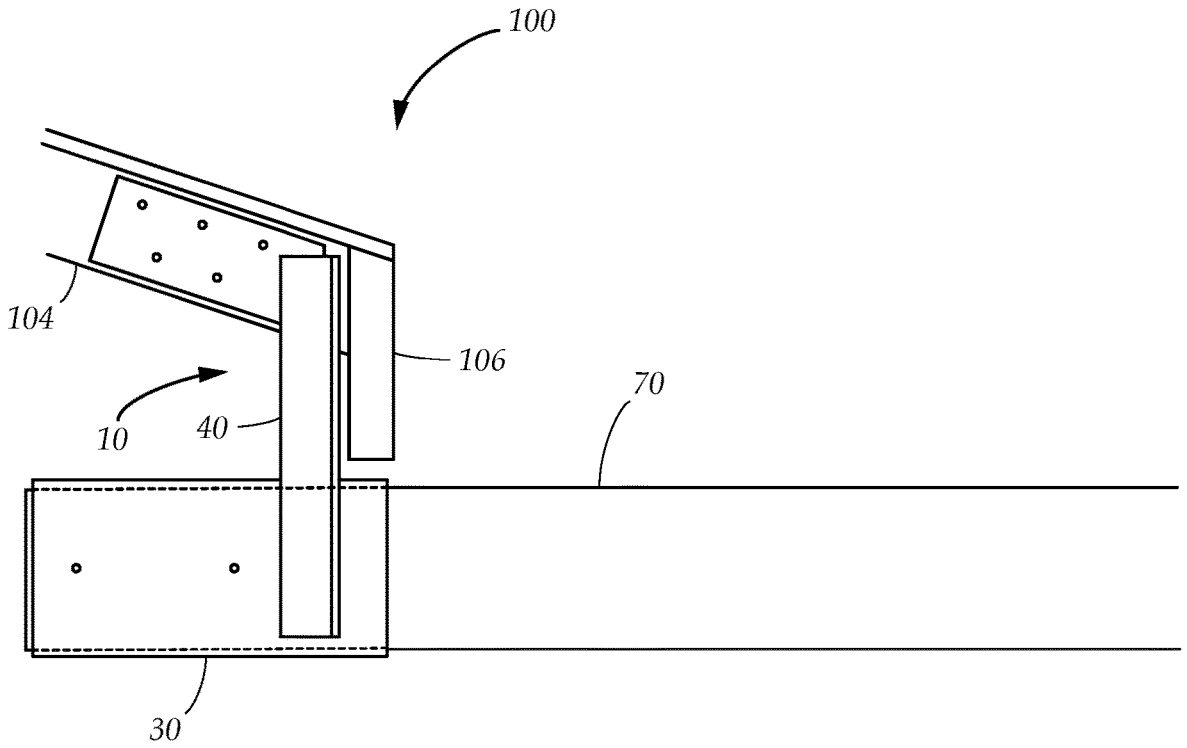
FIG. 4 is a side elevational view, illustrating a pergola beam, supported from the roof rafter by the bracket described herein.
Figure 6D:
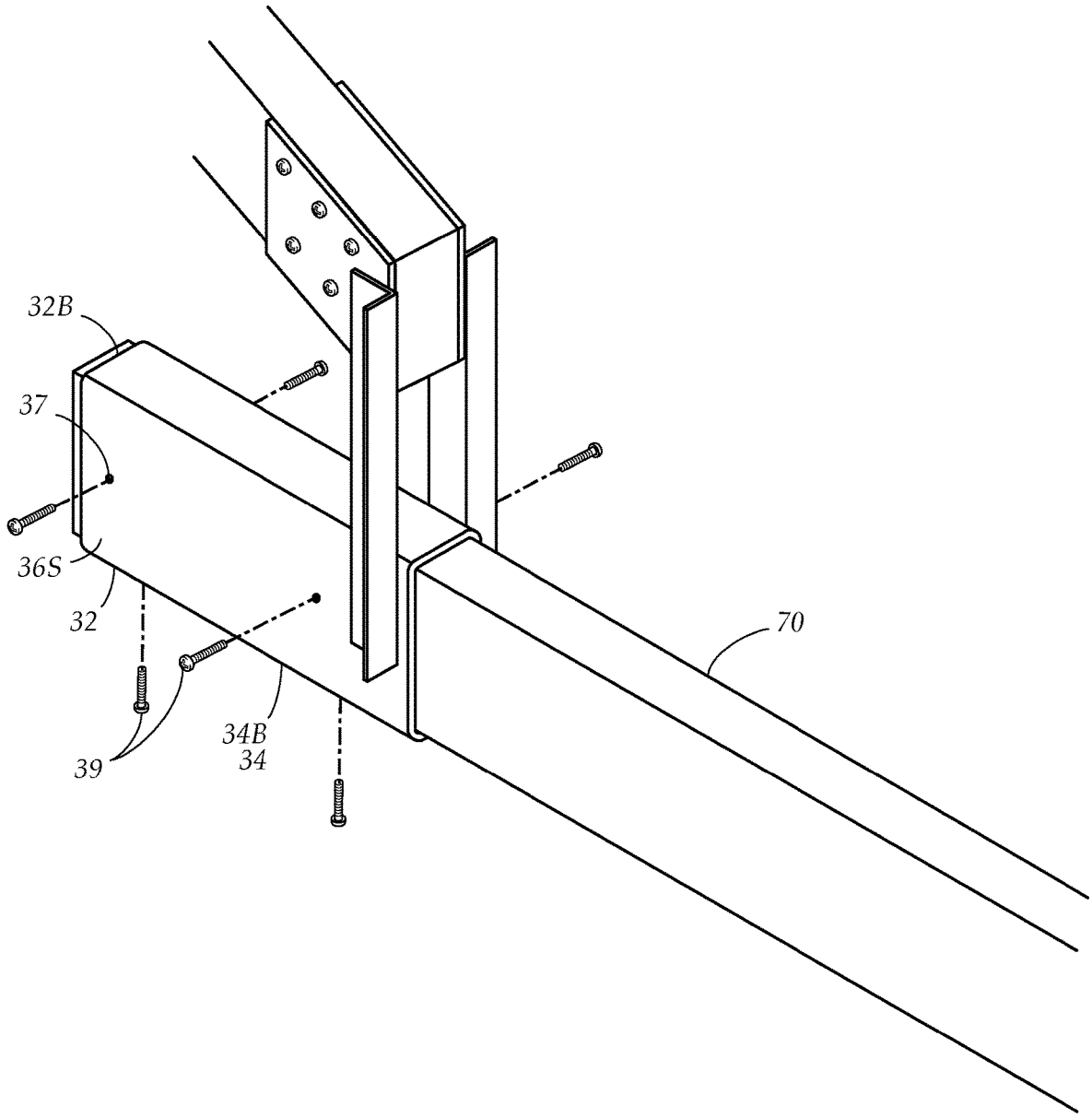
FIG. 6D is a diagrammatic perspective view, showing the pergola beam inserted fully into the support tube of the support assembly, and about to be fastened with support fasteners extending through the support holes.
Figure 6E:
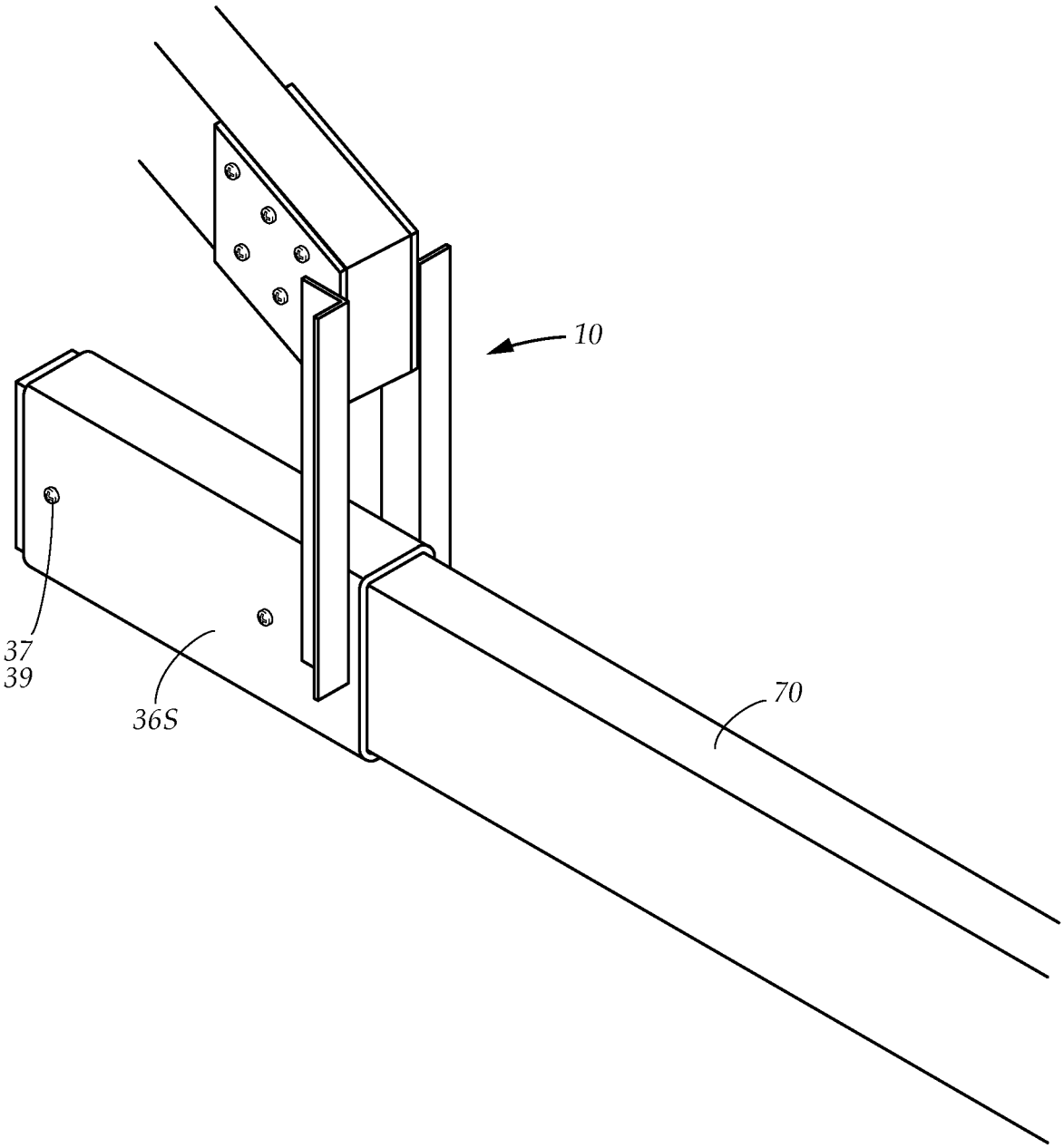
FIG. 6E is a diagrammatic perspective view, showing the pergola beam fully attached within the support assembly and thereby supported and cantilevered from the roof rafter by the bracket.

The pergola beam 70 extends fully through the support tube 32, and may extend beyond the second open end 32B as shown in FIG. 6D. Support fasteners 39, such as screws or bolts, are inserted through the support holes 37 in the side plate 36S and bottom plate 34B of the support tube 34 and into pergola beam 70 to secure the pergola beam 70 to the bracket 10 as also shown in FIG. 6E. As illustrated in FIG. 4, with the pergola beam 70 attached within the support assembly 30 the pergola beam is thereby rigidly supported from the rafter 104 by the bracket 10. The connecting assembly 40 positions the support assembly 30 just below the fascia board 106. The pergola beam 70 can extend horizontally well beyond the structure 100, without additional support.

Figure 7:
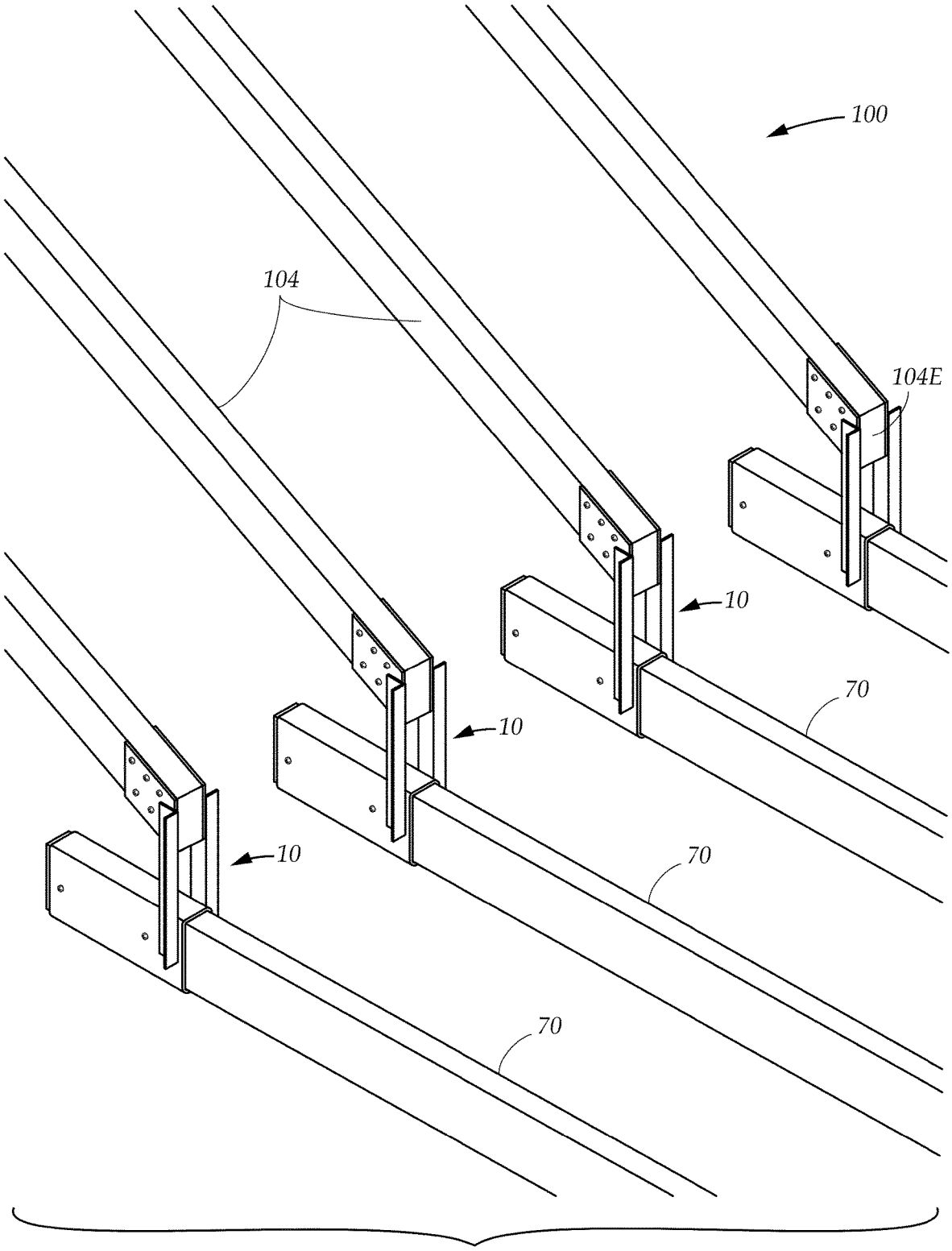
FIG. 7 shows a cantilevered pergola structure, formed by several pergola beams, extending in parallel, each supported from one of the roof rafters by one of the brackets described herein.

FIG. 7 illustrates how the pergola can be created with numerous pergola beams 70, each pergola beam 70 associated with one of the rafters 104 of the existing structure 100. Each pergola beam 70 having its own bracket 10 that connects it to its associated rafter 104. The pergola beams 70 may have transverse connects, such as for ornamental purposes or to increase the amount of shelter or sun protection. But importantly, no additional vertical support is required as the pergola is effectively cantilevered from the existing structure 100 by using the brackets 10.

Referring to FIGS. 2-3, FIG. 5, and FIG. 6B, the advantages of the bracket 10 allow for pergola beams 70 to be attached to the roof rafters 104 without interfering with other components of the existing structure 100 which may be attached thereto. The rafter top 104T will typically be completely covered by roofing material 108, such as roofing boards and shingles. However, a rafter bottom 104B disposed opposite the rafter top 104T may remain accessible. In a preferred embodiment, the mounting assembly 20 has a mounting gap 22G formed between the inside surfaces 22A of the pair of mounting plates 22. The mounting gap 22G corresponds to a void space which is open and accessible between the top edges 22T of the pair of mounting plates 22. The top edges 22T extend upwardly away from the top of the support assembly. The roof rafter 104 may therefore pass into the mounting gap 22G through the top edges 22T.

In another embodiment, each of the mounting plates 22 has a rear edge 22R positioned substantially parallel to the front edge 22F. The mounting gap 22G may be continuously open and accessible along the front edges 22F, the top edges 22T, and the rear edges 22R of the mounting plates 22.

The mounting gap 22G allows the bracket 10 to be secured to the roof rafter 104 by positioning the mounting assembly 20 below the rafter bottom 104B and then raising the mounting assembly 20 upwardly so that the rafter bottom 104B passes through mounting gap 22G between the top edges 22T of the mounting plates 22. The inside surfaces 22A of the mounting plates 22 are then placed in contact with the rafter sides 104S, and the mounting plates 22 are secured to the roof rafter 104 using mounting fasteners 27.

In some embodiments, the mounting gap 22G is open and accessible through the bottom edges 22B of the mounting plates 22, thus allowing the rafter bottom 104B to extend downwardly past the bottom edges 22B when the mounting plates 22 have been secured to the roof rafter 104. This allows the mounting assembly 20 to accommodate roof rafters 104 with a rafter height, as measured between the rafter top 104T and the rafter bottom 104B, which is greater than a mounting assembly height as measured between and the bottom edge 22B of the mounting plates 22.

Furthermore, the mounting gap 22G allows the mounting assembly 20 to be attached to the roof rafter 104 even when the rafter end 104E is covered by the fascia board 106, as the mounting assembly 20 may be secured to a point disposed inwardly along the roof rafter 104 away from the rafter end 104E.

Figure 8A:
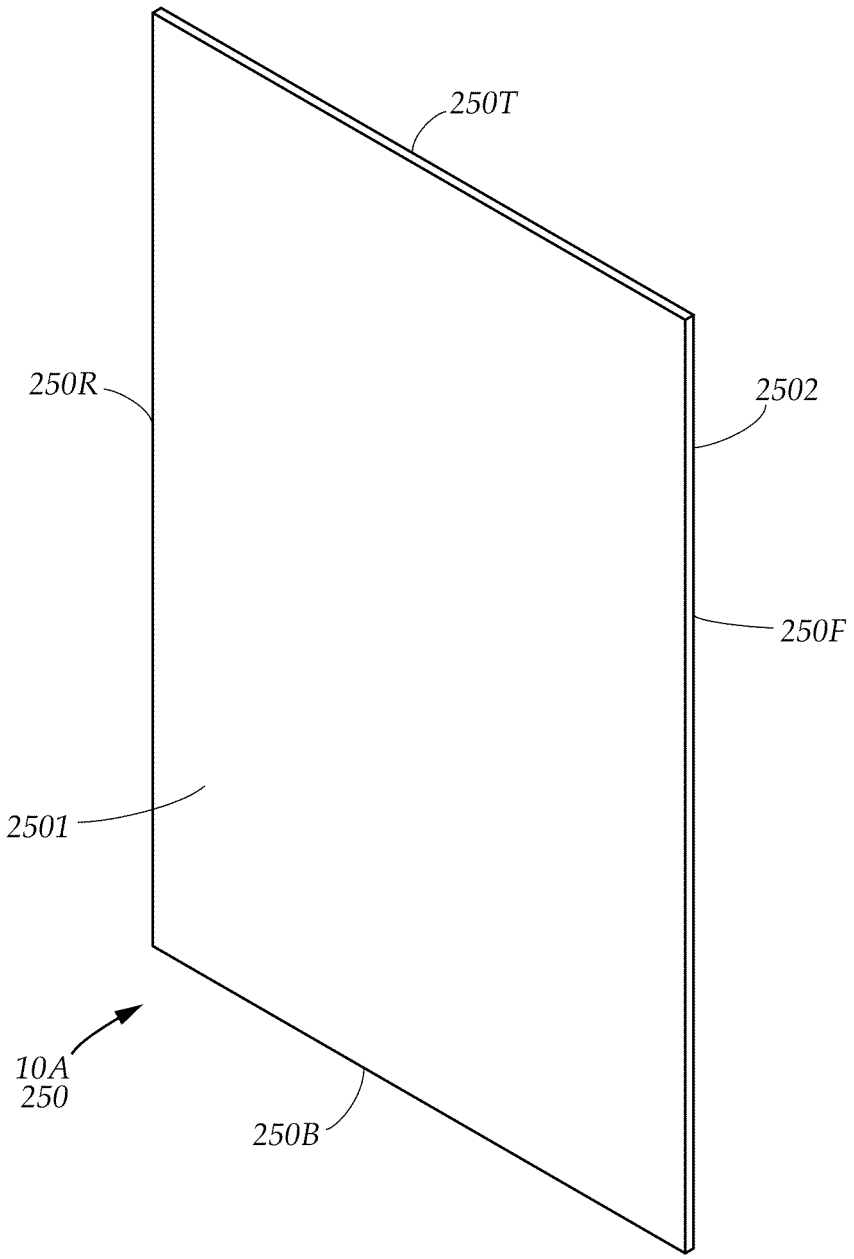
FIG. 8A is a diagrammatic perspective view, illustrating an initial step in fabrication of an embodiment of the bracket, originating from a rectangular plate.
Figure 8B:
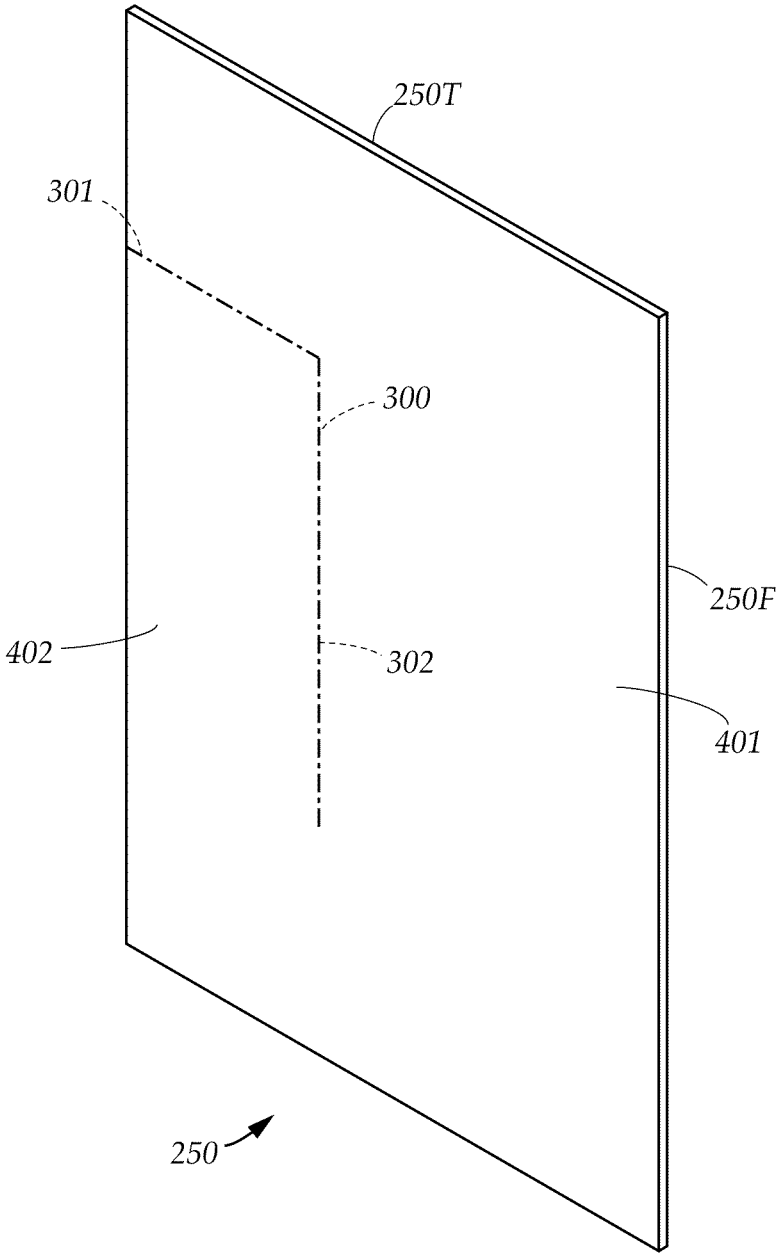
FIG. 8B is a diagrammatic perspective view, illustrating a next step in fabrication of an embodiment of the bracket, wherein the rectangular plate has been scored and/or cut.
Figure 8C:
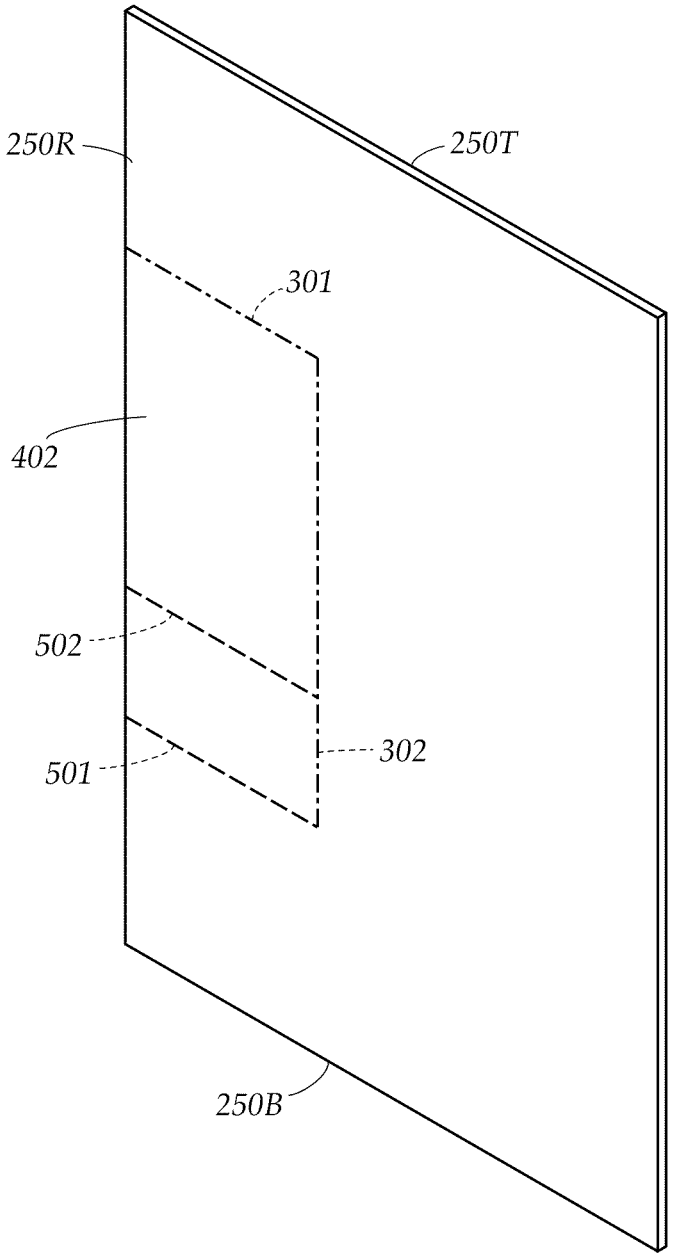
FIG. 8C is a diagrammatic perspective view similar to FIG. 8B, illustrating a following step in fabrication of an embodiment of the bracket, also showing a secondary region with two future bend points.

Referring to FIG. 8A, an embodiment of the bracket 10A may be formed from a rectangular plate 250, having a top edge 250T, bottom edge 250B, a forward edge 250F, and a rear edge 250R. The rectangular plate 250 also having a first side 2501 and a second side 2502. As illustrated in FIG. 8B, A cut line 300 is illustrated, having a first cut 301 that extends parallel to the top edge 250T, and a second cut 302 that extends parallel to the forward edge 250F. The cut line 300 begins to define and distinguish a secondary region 402 from a main region 401 of the rectangular plate 250. Then referring to FIG. 8C, a first fold line 501 and a second fold line 502 extend from the second cut 302 to the rear edge 250R, substantially parallel to the first cut 301 and top edge 250T. Then referring to FIG. 8D, the secondary region 402 has been separated from the main region 401 along the cut line 300, and folded orthogonally along the first fold line 501 and second fold line 502 to create the support assembly 30, the secondary region 402 having a distal edge 402D at the edge separated from the first cut 301. The support assembly 30 in this embodiment is a generally rectangular three-sided support, having an open first end 32A and an open second end 32B. Between the first end and second end are the top plate 34A, and the pair of side plates 36S. Note that the top plate 34A, and side plates 36S together define the support tube 32.

While shown here open at its bottom, the support tube 32 may be closed at the bottom, such as by adjusting the overall size of the rectangular plate 250 between the top edge 250T and bottom edge 250B, and thereby adjusting the size of the secondary region 402 (see FIG. 8C momentarily) between the distal edge 402D and the first fold line 501, so that the secondary region 402 can be orthogonally folded again near the first cut 301 with an additional fold line, and then secured to the plate bottom edge 250B to enclose the support tube 32 on four sides. To wrap fully around and make a secure connection between the secondary region 402 and plate bottom edge 250B, the secondary region 402 can even be folded yet again near the first cut 301 where it meets the plate bottom edge 250B, to create a tab that wraps around the bottom edge 250B and extends upwardly against the first side to fasten thereto.

Figure 8D:
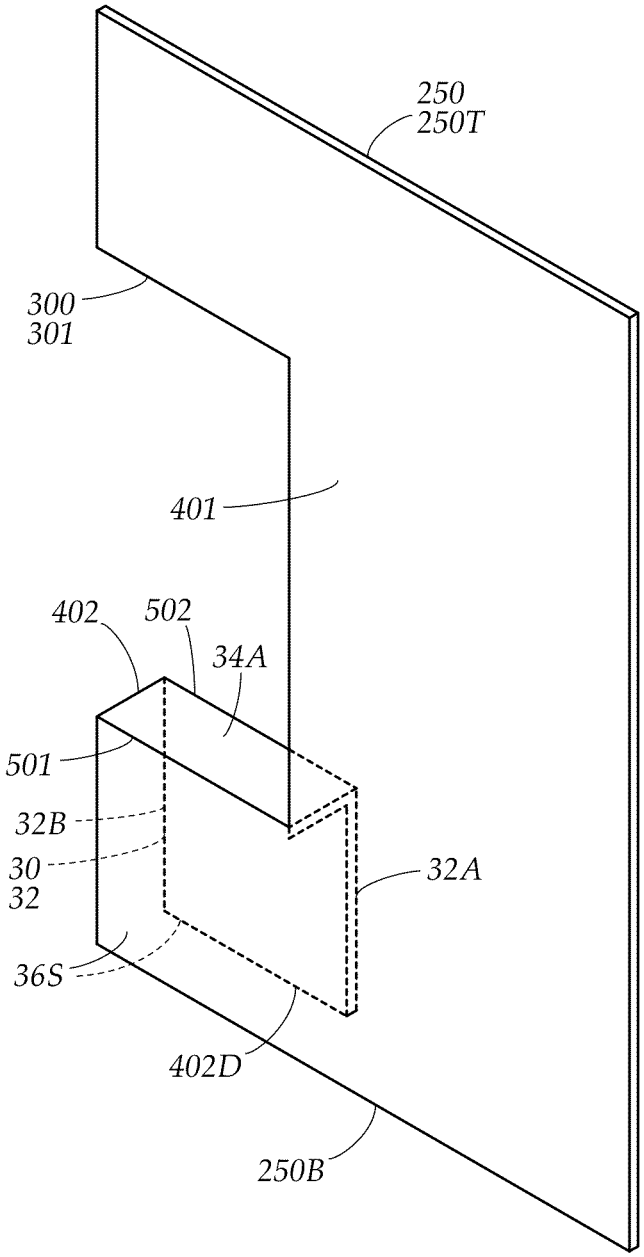
FIG. 8D is a diagrammatic perspective view, illustrating another step in the fabrication of an embodiment of the bracket, wherein the secondary region has formed a support assembly, by creating two orthogonal bends in the secondary region.

In the embodiment shown in FIG. 8D, the top plate 34A of the support tube extends between the first fold line 501 and second fold line 502. One of the side plates 36S of the support tube 32 extends between the distal edge 402D and the second fold line 502 and the other side plate 36S is the part of the main region 401 between the first fold line 501 and the plate bottom edge 250B, such that the support tube 32 is defined on at least three orthogonal sides by the top plate 34A and the side plates 36S.

Figure 8E:
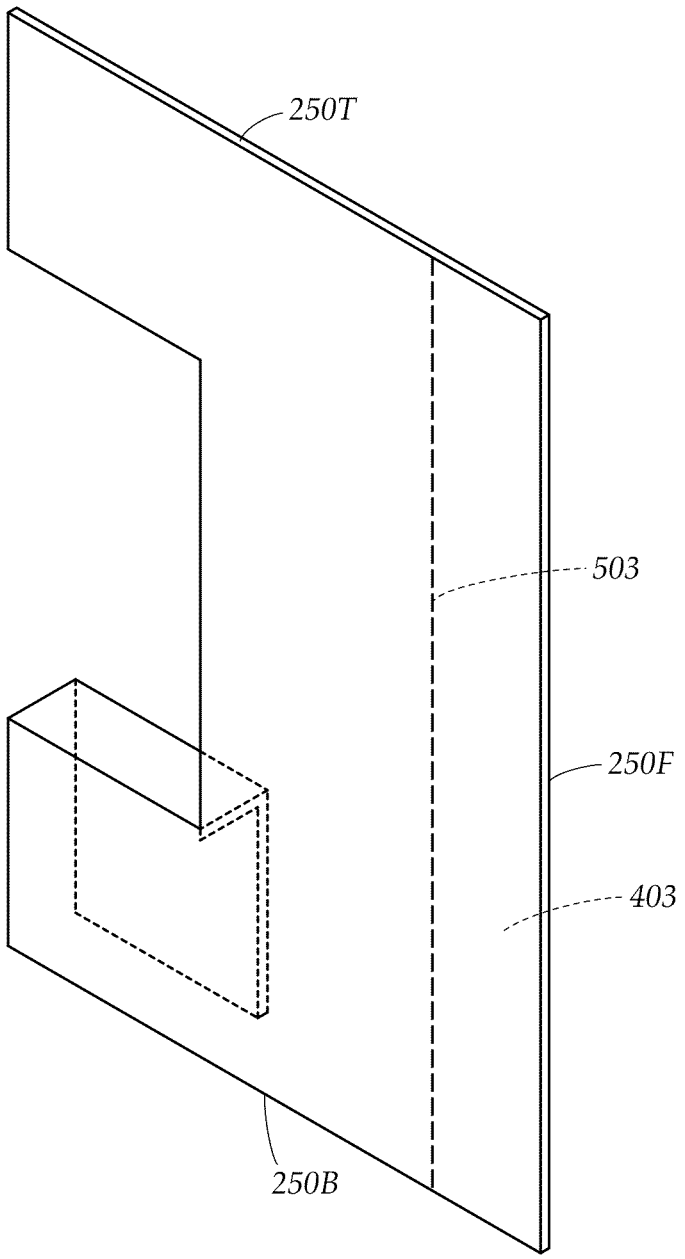
FIG. 8E is a diagrammatic perspective view, showing a vertical bend line within the vertical plate to define a tertiary region from the main region.
Figure 8F:
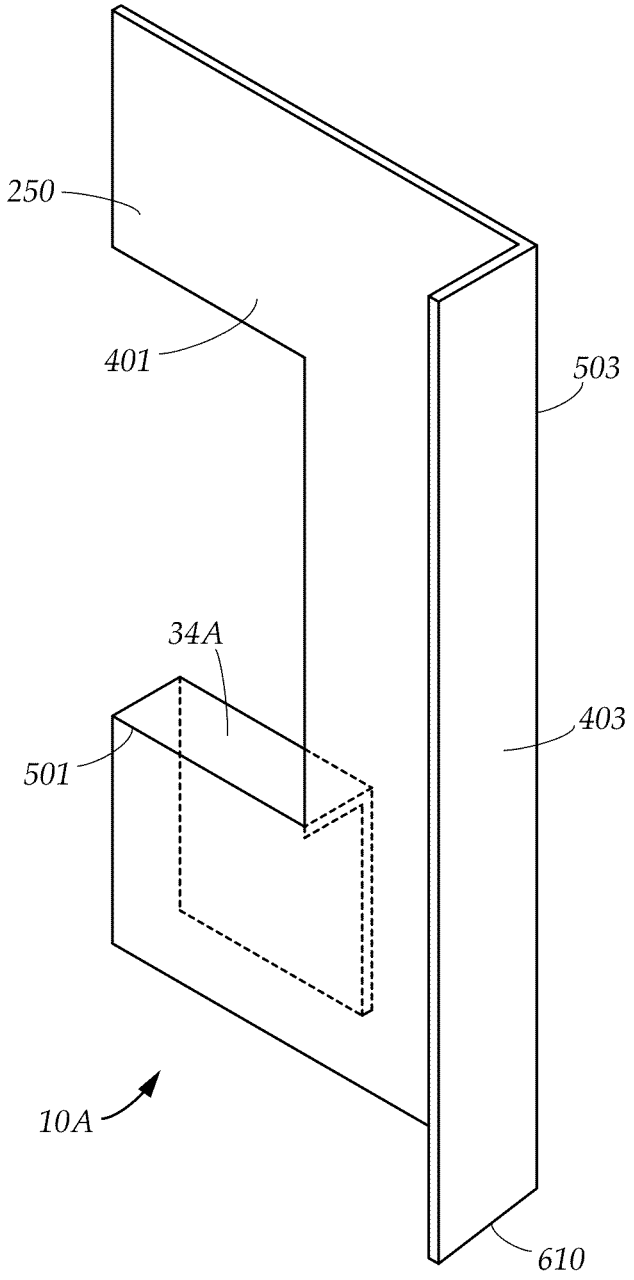
FIG. 8F is a diagrammatic perspective view, illustrating a further step in fabrication, wherein a vertical brace has been formed by creating an orthogonal bend between the tertiary region and the main region.

Referring to FIG. 8E, a third fold line 503 extends vertically between the top edge 250T and bottom edge 250B, substantially parallel to and near the forward edge 250F, defining a tertiary region 403. Then, referring to FIG. 8F, an embodiment of the bracket 10A is shown, having been created from the rectangular plate 250 through the method shown in FIG. 8A-8F. In particular, as a final step an orthogonal fold is created along the third fold line 503 in a direction opposite from the bend of the top plate 34A at the first fold line 501, to create a vertical brace 610. The vertical brace 610 is defined by the tertiary region 403 and the main region 401.

Figure 12:
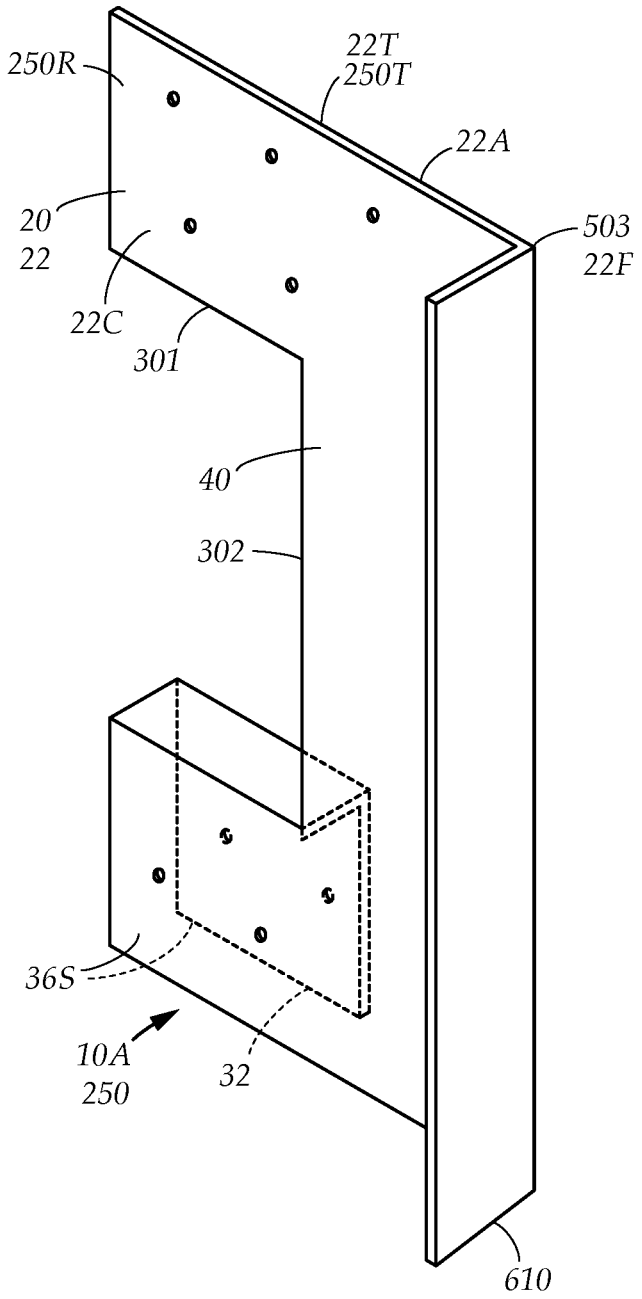
FIG. 12 is a diagrammatic perspective view of just the bracket, showing securement holes in the main region and secondary region.

With the vertical brace 610 thus defined, referring now to FIG. 12, the mounting assembly 20 or mounting plate 22 extends between the top edge 250T of the rectangular plate 250, the first cut 301, the rear edge 250R of the rectangular plate 250, and the third fold line 503. The outside surface 22C of the mounting plate 22 extends in the direction of the vertical brace 610, and the inside surface 22A in the direction of the support tube 32. The top edge 22T of the mounting plate is the top edge 250T of the rectangular plate 250. The front edge 22F of the mounting plate 22 is at the third fold line 503 and also the vertical brace 610. The connecting assembly 40 extends between the mounting plate 22, the support tube 32, the second cut 302, and the third fold line 503 (or vertical brace 610). The mounting plate 22 is coplanar with the connecting assembly 40 and one of the side plates 36S of the support tube 32. The vertical brace 610 extends fully alongside the mounting assembly 20, the connecting assembly 40 and the support tube 32. The vertical brace extends orthogonally at the third fold line 503 in a vertical plane away from the support tube 32. Advantageously, in this embodiment of the bracket 10A, the mounting plate 22, connecting assembly 40, support tube 32 of the bracket 10A are constructed from a single sheet of material—rectangular plate 250—that is cut and folded as described hereinabove.

Figure 9:
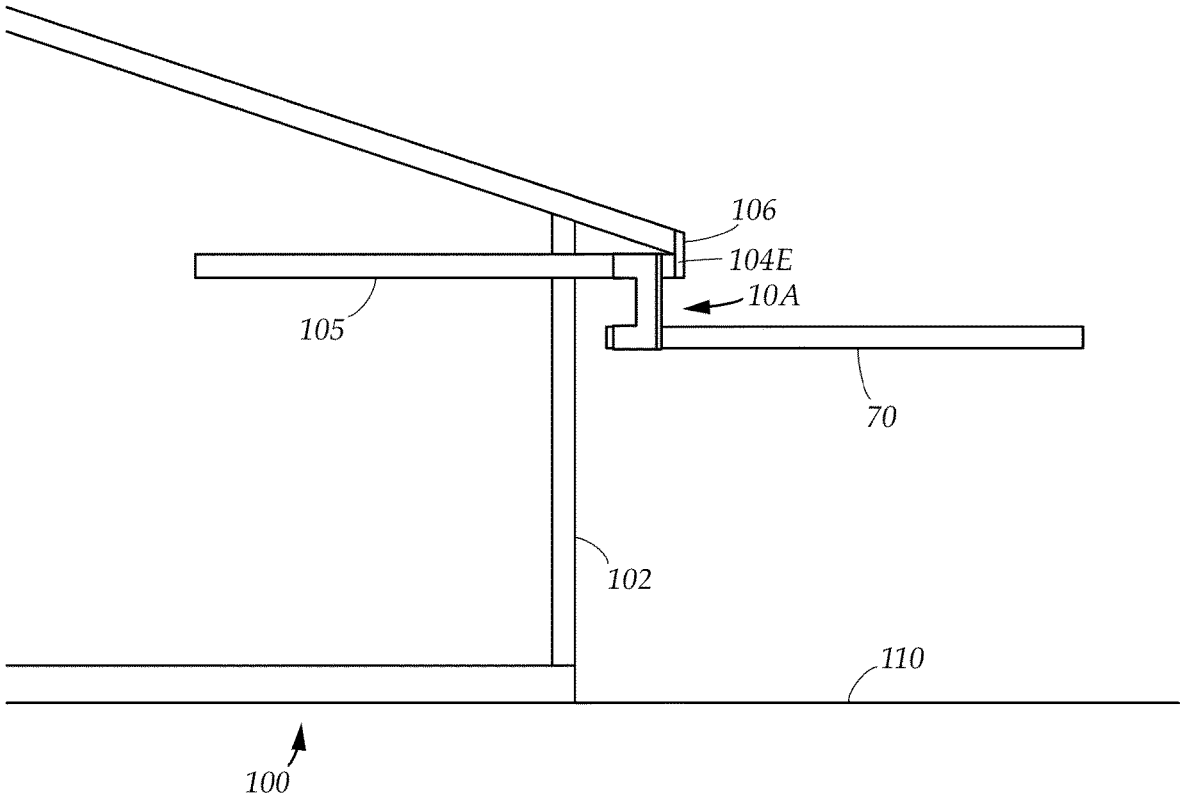
FIG. 9 is a side elevational view, illustrating the bracket embodiment of FIG. 8A-8F installed on a dwelling, secured to a horizontal roof rafter and supporting a pergola beam.

In accordance with the principles of the present disclosure, FIG. 9 shows an embodiment of the existing structure 100 having a plurality of horizontal rafters 105 that extend laterally beyond the vertical wall 102 substantially horizontally therefrom. The rafters 105 are parallel to each other, as better seen in FIG. 14. Each of the horizontal rafters 105 have a rafter end 104E. The fascia board 106 is secured across the horizontal rafter ends 104E. A plurality of brackets 10A are provided to each support one of the pergola beams 70 such that the pergola beams 70 extend horizontally over the ground surface 110. Each bracket 10A is secured to one of the horizontal rafters 105. The pergola beams 70 are solely supported by the brackets 10A and do not require other support. Notably, the brackets 10A allow the pergola beams 70 to extend horizontally over the ground surface 110 without additional support.

Figure 11:
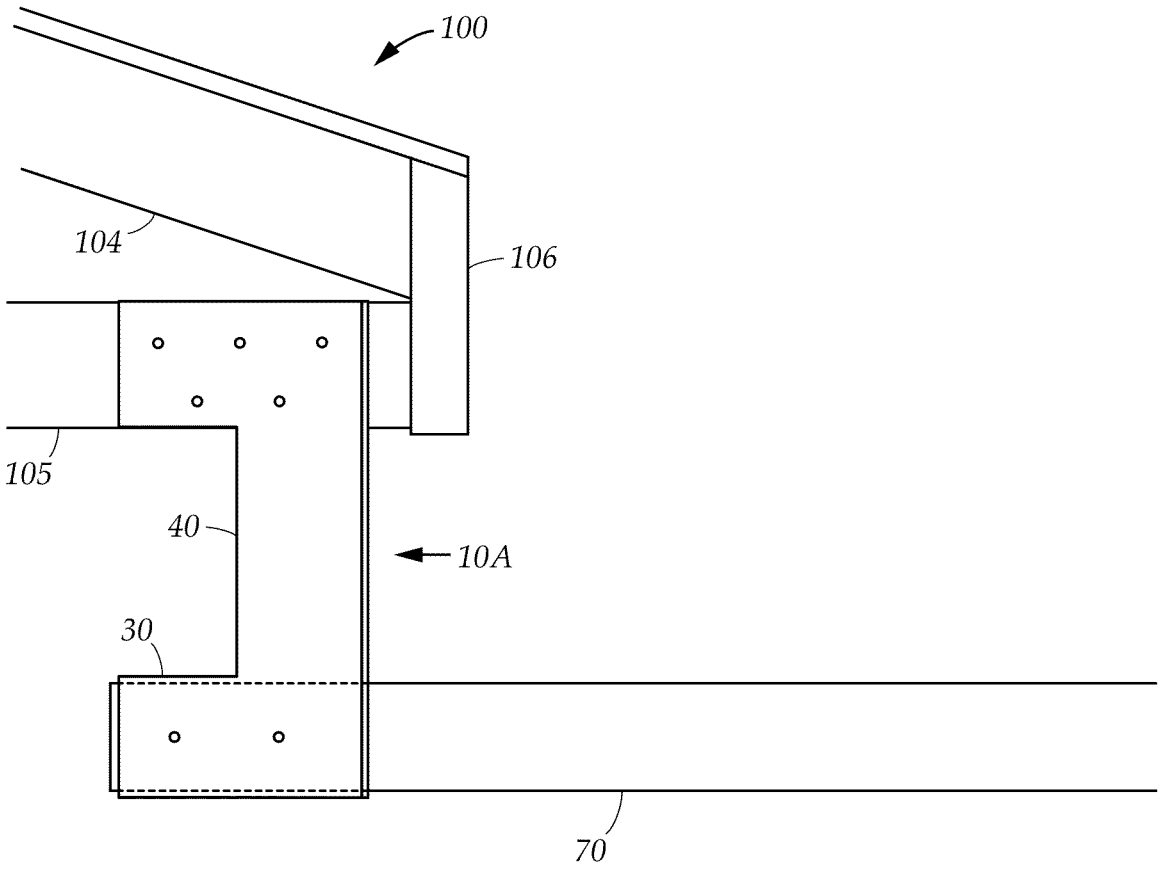
FIG. 11 is a side elevational view, further illustrating the support position of the pergola beam.

FIG. 11 Also shows the bracket 10A in use, securing the pergola beam 70 to one of the horizontal rafters 105. Depending on the framing of the dwelling 100, the horizontal rafter 105 may be part of a flat roof, or also considered a ceiling joist. In the embodiment shown the horizontal rafter 105 meets the roof rafter 104 at an acute angle at a fascia board 106.

Figure 13A:
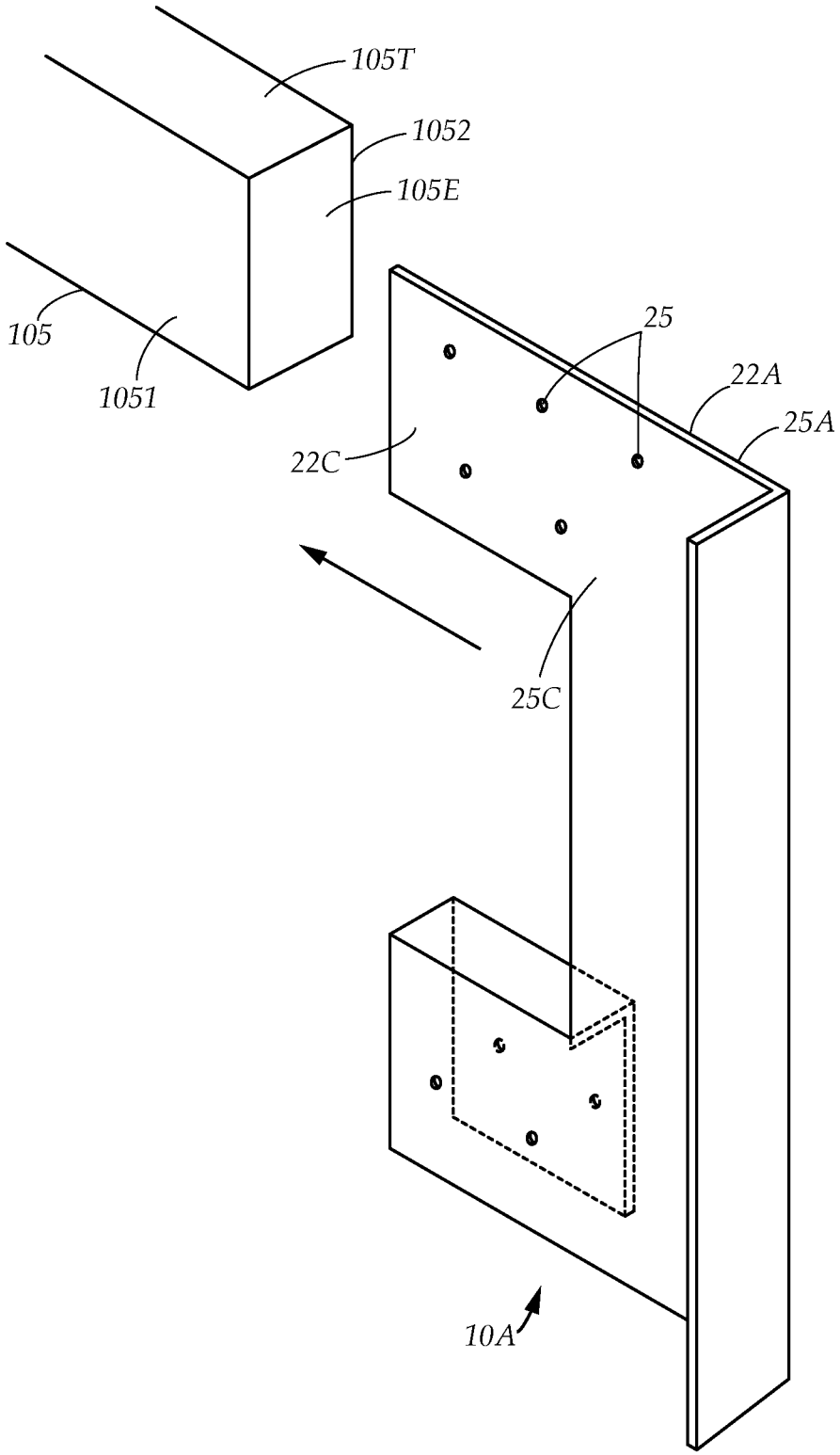
FIG. 13A is a diagrammatic perspective view, illustrating the bracket, about to be installed to a horizontal roof rafter.

Referring to FIG. 13A, the bracket 10A is generally configured in accordance with dimensions of the horizontal rafter 105. In particular, the horizontal rafter 105 has a horizontal rafter top 105T, a first horizontal rafter side 1051, and a second horizontal rafter side 1052. Note that the mounting holes 25 that extend fully between the outside surface 22C and inside surface 22A of the bracket 10A.

Figure 10:
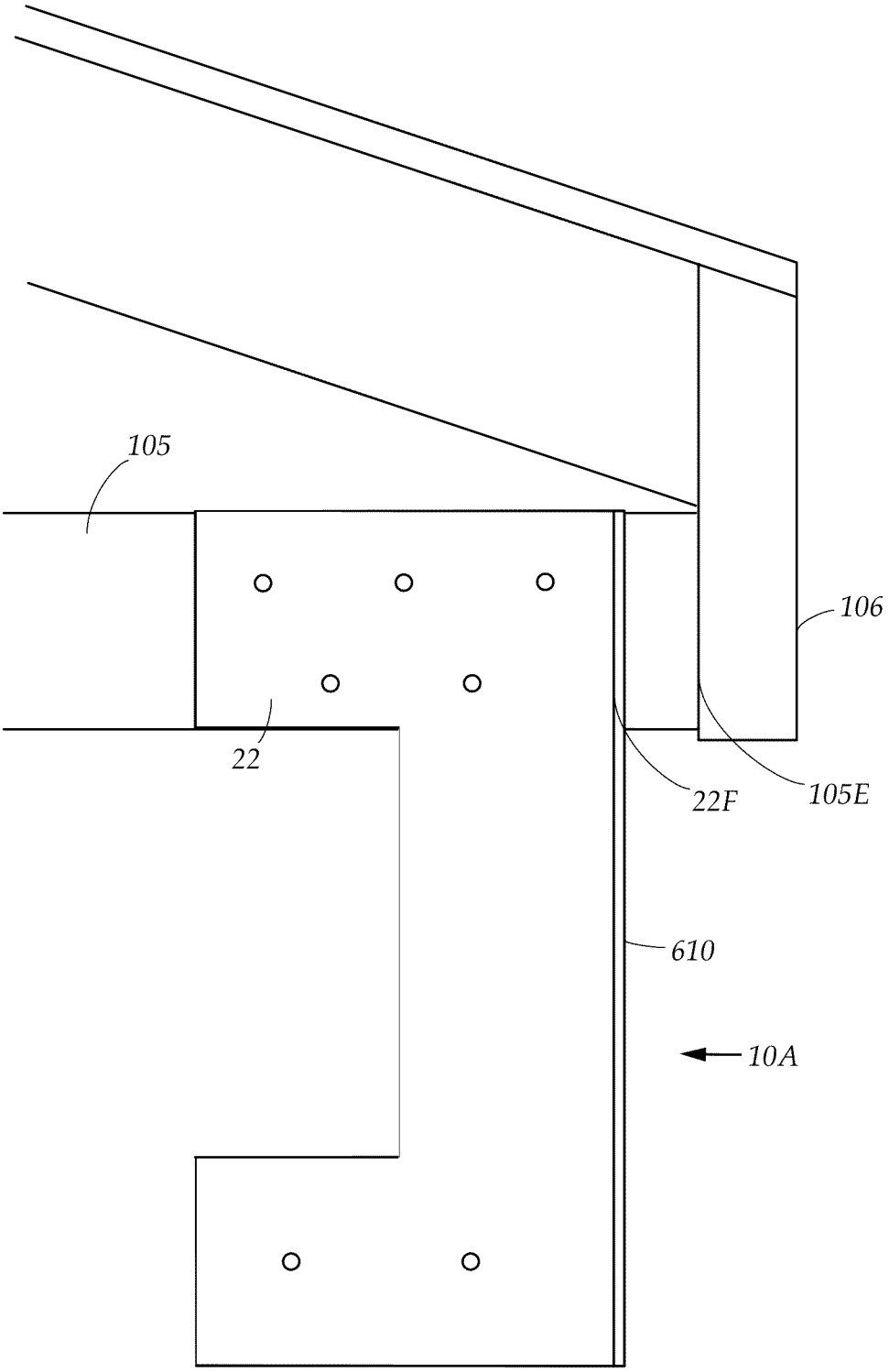
FIG. 10 is a side elevational view, further illustrating the bracket secured to the horizontal roof rafter and supporting a pergola beam.
Figure 13B:
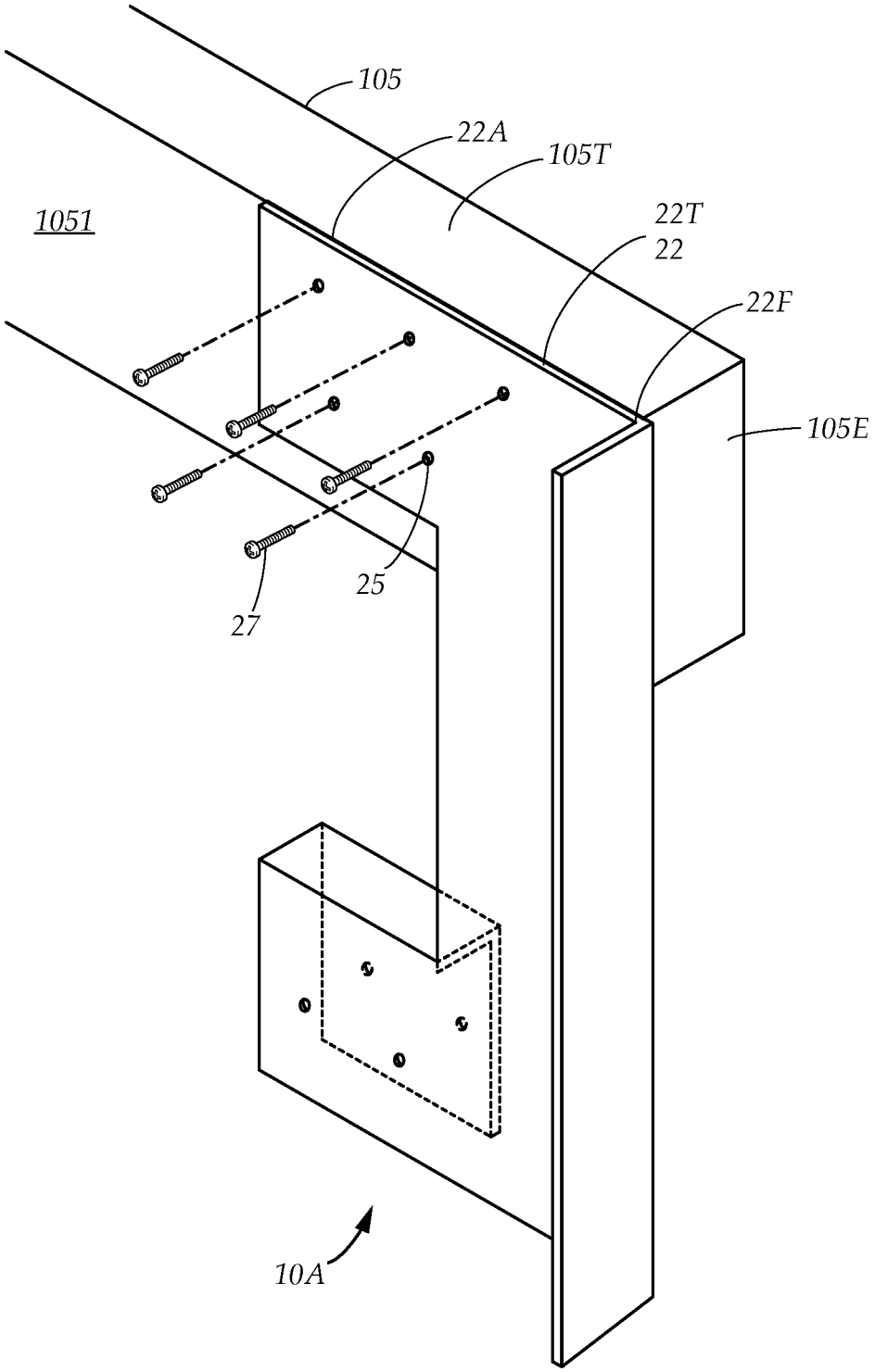
FIG. 13B is a diagrammatic perspective view, wherein the bracket is in place against a horizontal roof rafter, and is about to be secured by fasteners.

Referring to FIG. 13B, the horizontal rafter 105 has been positioned against the mounting plate 22 of the bracket 10A, and is shown in this example with the horizontal rafter end 105E aligned with the front edge 22F of the mounting plate 22, the first horizontal rafter side 1051 against the inside surface 22A of the mounting plate 22, and the rafter top 105T corresponding with the top edge 22T of the mounting plate 22. Mounting fasteners 27, such as screws or bolts, are inserted through the mounting holes 25 in the mounting plate 22 and into the first side 1501 of the horizontal rafter 105 to secure the rafter 105 to the bracket 10A. Note, referring to FIG. 10, when the rafter ends 105E are not exposed, the bracket 10A may be backed off slightly along the horizontal rafter 105 a small distance from the rafter end 105E, prior to fastening, such that front edge 22F of the mounting plate 22 and the vertical brace 610 are near and extend parallel to the rafter end 105E. This positions the mounting plate 22 and vertical brace 610 interior to the fascia board 106 that is secured across the rafter ends 105E. Note that the connecting assembly 40 provides a vertical offset for the support assembly 30, such that the support assembly 30 is positioned below the roofline and below the fascia board 106, to thereby be at the right height for support of the pergola as described next and as will be seen in FIG. 9 and FIG. 11.

Figure 13C:
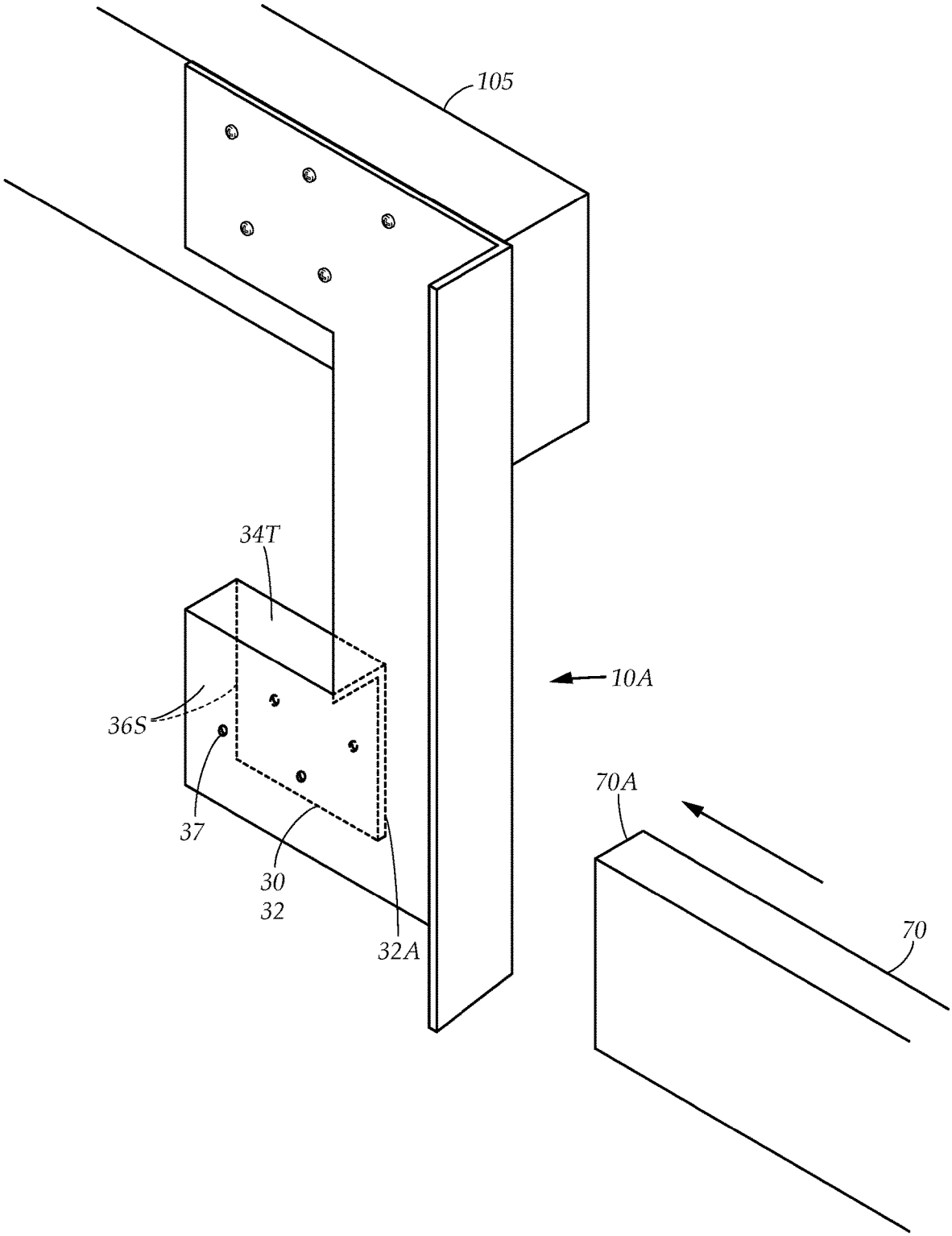
FIG. 13C is a diagrammatic perspective view, wherein the bracket is secure to the roof rafter, and a pergola beam is about to be installed to the bracket.

With the horizontal rafter 105 secured to the bracket 10A, the pergola beam 70 may be inserted into the support assembly 30 as shown in FIG. 13C. In particular, the supported end 70A of the pergola beam 70 is inserted longitudinally into the first open end 32A of the support tube 32 of the support assembly 30 and positioned against the top plate 34T of the support tube 32. To facilitate a strong structural connection with the pergola beam 70, the side plates 36S of the support assembly 30 have support holes 37 that extend fully through the side plates 36S. The support holes 37 may be aligned between the side plates 36S to allow fasteners to extend fully therebetween or may be offset.

Figure 13D:
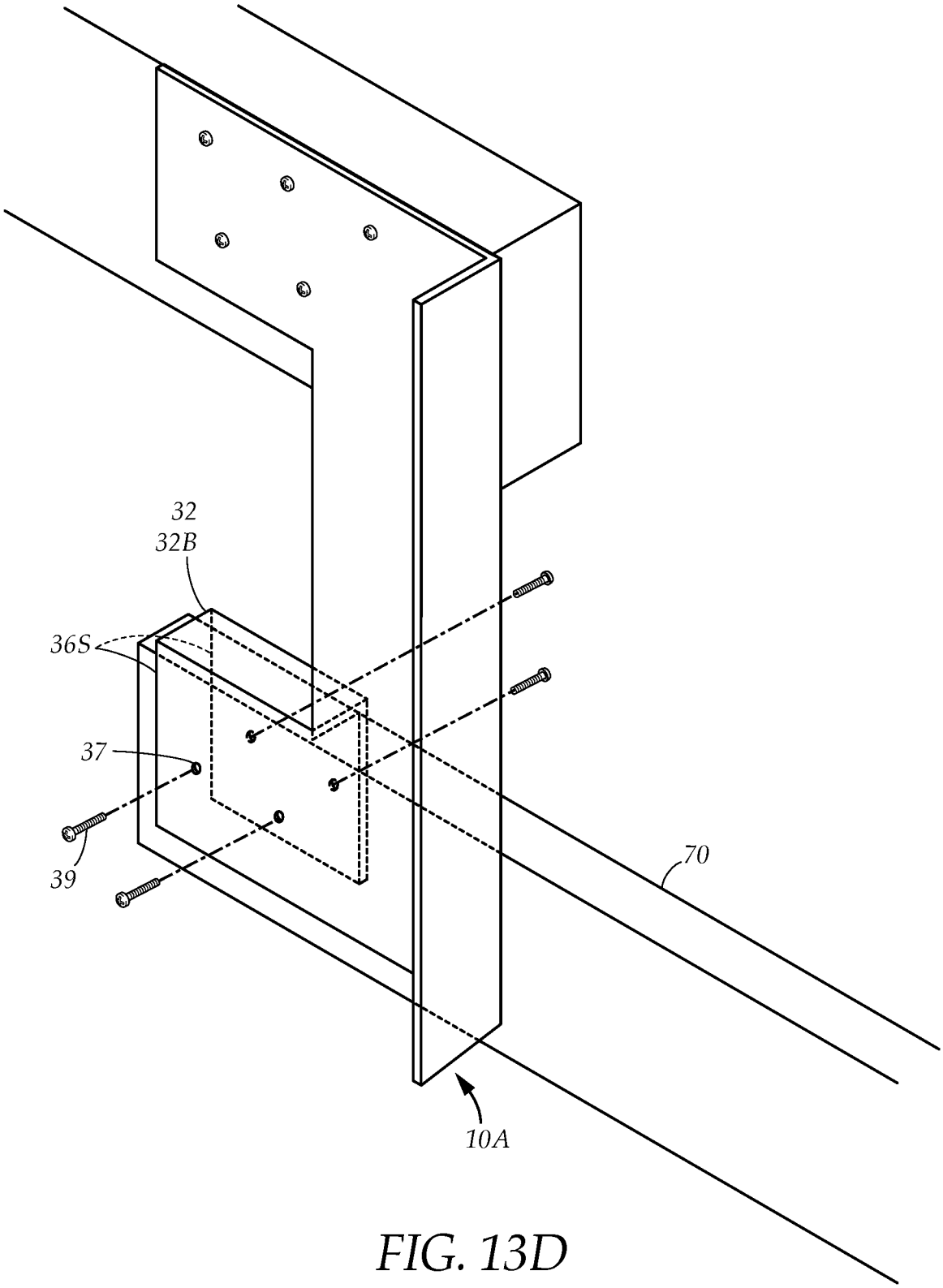
FIG. 13D is a diagrammatic perspective view, wherein the pergola beam is in place, and is about to be secured by fasteners.
Figure 13E:
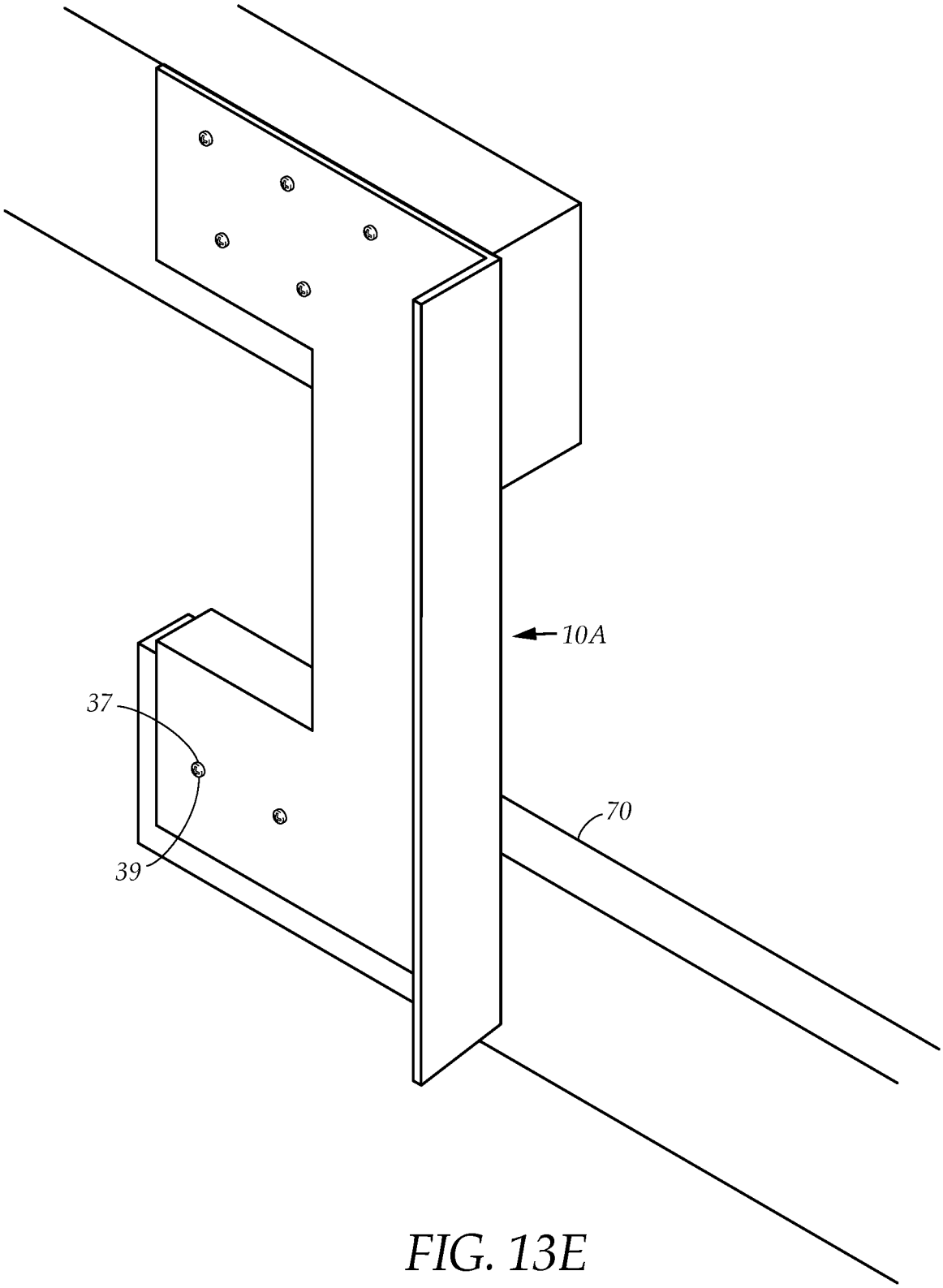
FIG. 13E is a diagrammatic perspective view, wherein the pergola beam is securely attached to the bracket.

The pergola beam 70 extends fully through the support tube 32, and may extend beyond the second open end 32B as shown in FIG. 13D. Support fasteners 39, such as screws or bolts, are inserted through the support holes 37 in the side plate 36S of the support tube 32 and into pergola beam 70 to secure the pergola beam 70 to the bracket 10A as also shown in FIG. 13E. As illustrated in FIG. 11, with the pergola beam 70 attached within the support assembly 30 the pergola beam is thereby rigidly supported from the rafter 105 by the bracket 10A. The connecting assembly 40 positions the support assembly 30 just below the fascia board 106. The pergola beam 70 can extend horizontally well beyond the structure 100, without additional support.

Figure 14:
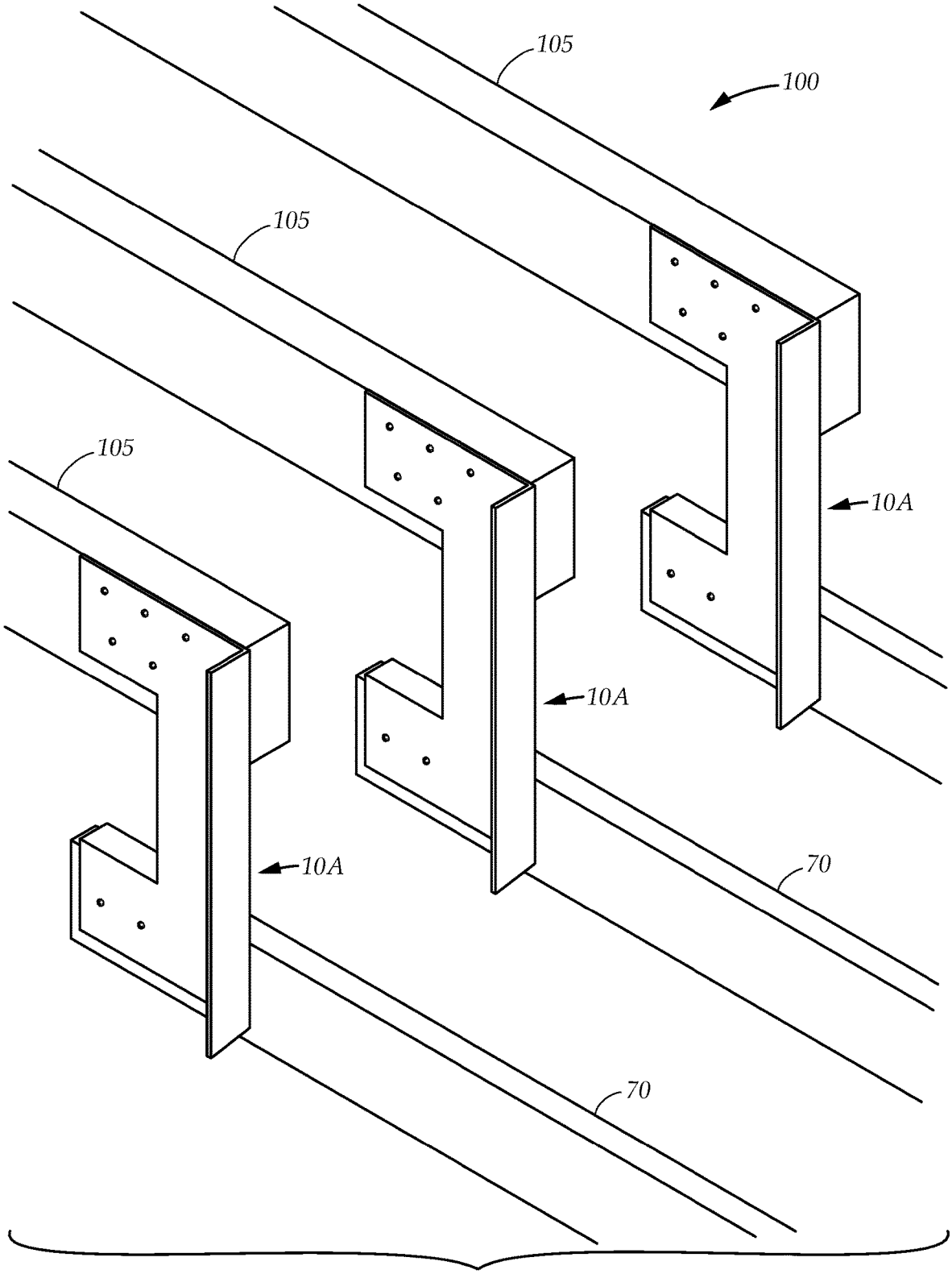
FIG. 14 is a diagrammatic perspective view, showing a cantilevered pergola structure, formed by several pergola beams, extending in parallel, each supported from one of the horizontal rafters by one of the brackets described herein.

FIG. 14 illustrates how the pergola can be created with numerous pergola beams 70, each pergola beam 70 associated with one of the horizontal rafters 105 of the existing structure 100. Each pergola beam 70 has its own bracket 10A that connects it to its associated horizontal rafter 105. The pergola beams 70 may have transverse connects, such as for ornamental purposes or to increase the amount of shelter or sun protection. But importantly with this embodiment of the bracket 10A as well—no additional vertical support is required as the pergola is effectively cantilevered from the existing structure 100 by using the brackets 10A.

Figure 15:
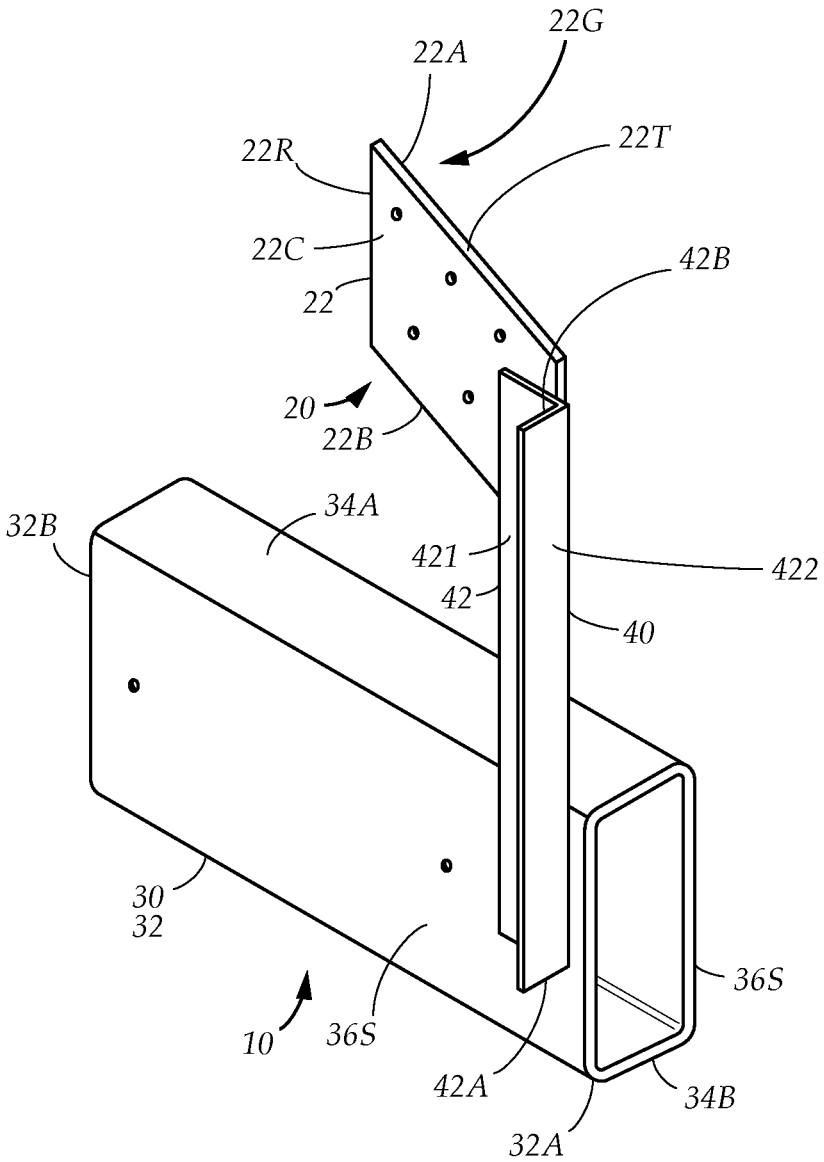
FIG. 15 is a diagrammatic perspective view, illustrating a further embodiment of the bracket.

FIG. 15 illustrates another embodiment, employing bracket 10B that has a mounting assembly 20 similar to bracket 10 of FIG. 1-7. except including just one of the mounting plates 22 therefrom. Bracket 10B further has the support assembly 30 generally as shown in the embodiment of FIG. 1-FIG. 7, but the connecting assembly 40 in this embodiment has just one vertical arm 42 to connect the mounting assembly 20 and support assembly 30.

The mounting plate 22 has its inside surface 22A, outside surface 22C, top 22T and bottom edges 22B. The mounting plate 22 extends vertically with the inside surface 22A facing toward the support assembly 30, and the outside surface facing the vertical arm 42. The support assembly 30 has a top and is shown configured as a generally rectangular support tube 32 having an open first end 32A and an open second end 32B. Between the first end and second end are the top plate 34A, the bottom plate 34B, and the pair of side plates 36S. Note that the top plate 34A, bottom plates 34B, and side plates 36S together define the support tube 32. The vertical arm 42 of the connecting assembly 40 may each be an extruded right angle member having a longitudinal face 421 and a transverse face 422, a first end 42A and a second end 42B. The longitudinal face 421 of the vertical arm 42 is attached to one of the side plates 36S near the first end 42A of said vertical arm 42. The longitudinal face 421 of the vertical arm 42 is attached to the outside surface 22C of the mounting plate 22 near the second end 42B of said vertical arm 42. With the top plate 34A of the support assembly 30 extending substantially horizontally, the top 22T and bottom 22B edges of each mounting plate 22 are angled upwardly at an acute angle with respect to horizontal and with respect to the top plate 34A of the support assembly 30.

Figure 16A:
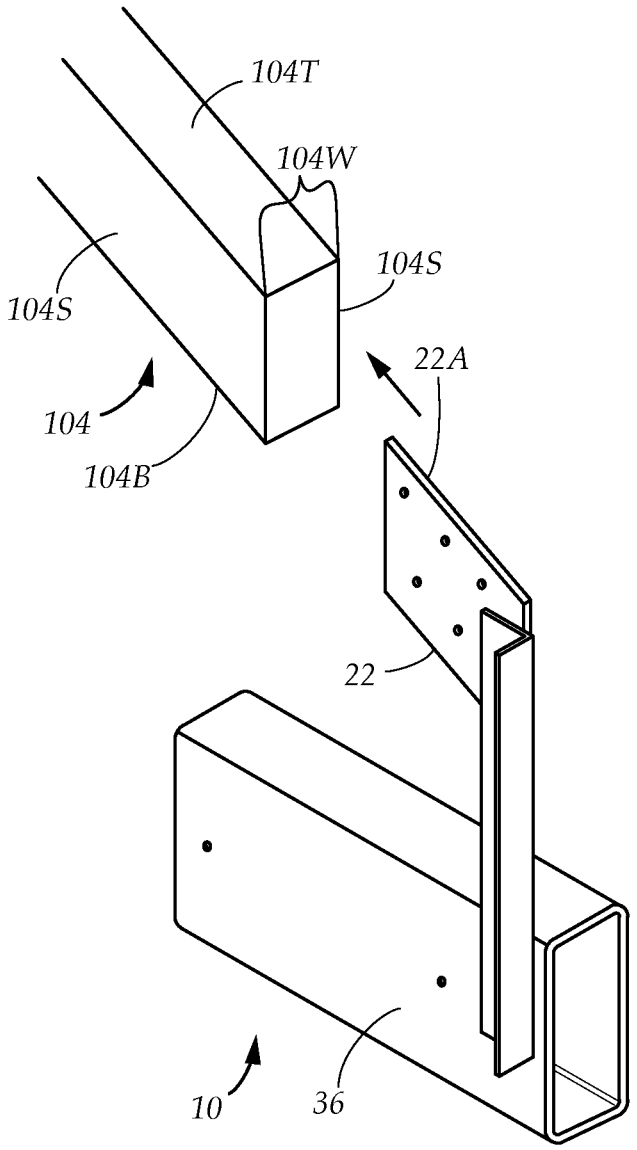
FIG. 16A is a diagrammatic perspective view, illustrating the further embodiment of the bracket about to be attached to one of the rafters.

Referring to FIG. 16A, the bracket 10B is generally configured in accordance with dimensions of the roof rafter 104. Note that the mounting plate 22 has mounting holes 25 that extend fully between the outside surface 22C and inside surface 22A.

Figure 16B:
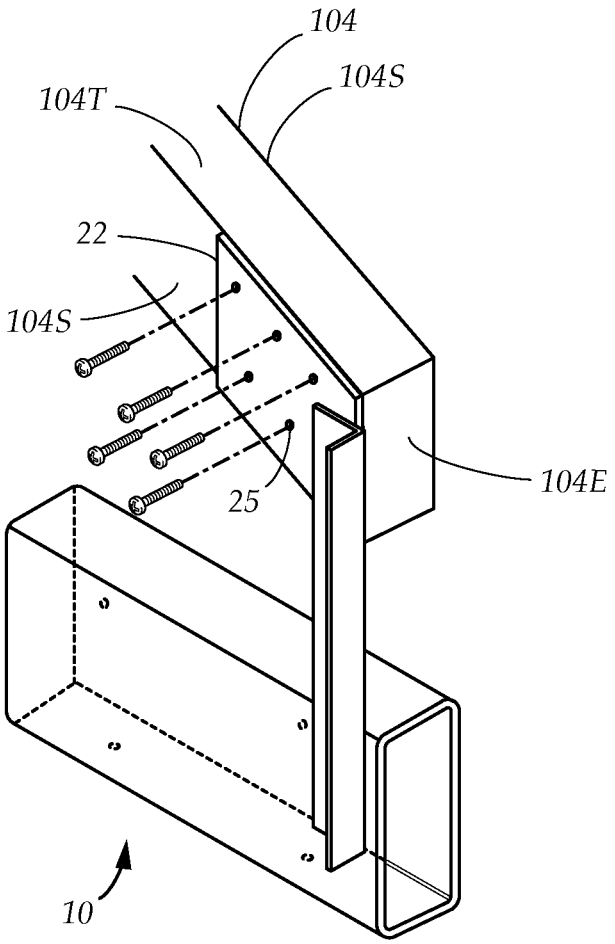
FIG. 16B is a diagrammatic perspective view illustrating the roof rafter extending within the mounting assembly, with mounting fasteners about to secure the mounting assembly to the roof rafter.

Referring to FIG. 16B, the rafter 104 has been positioned against the mounting plate 22 and is shown in this example with the rafter end 104E aligned with the front edge 22F of the mounting plate 22, one of the rafter sides 104S against the inside surface 22A of the mounting plate 22, and the rafter top 104T corresponding with the top edge 22T of the mounting plate 22. Mounting fasteners 27, such as screws or bolts, are inserted through the mounting holes 25 in the mounting plate 22 and into one of the sides 104S of the rafter 104 to secure the rafter 104 to the bracket 10B.

Figure 16C:
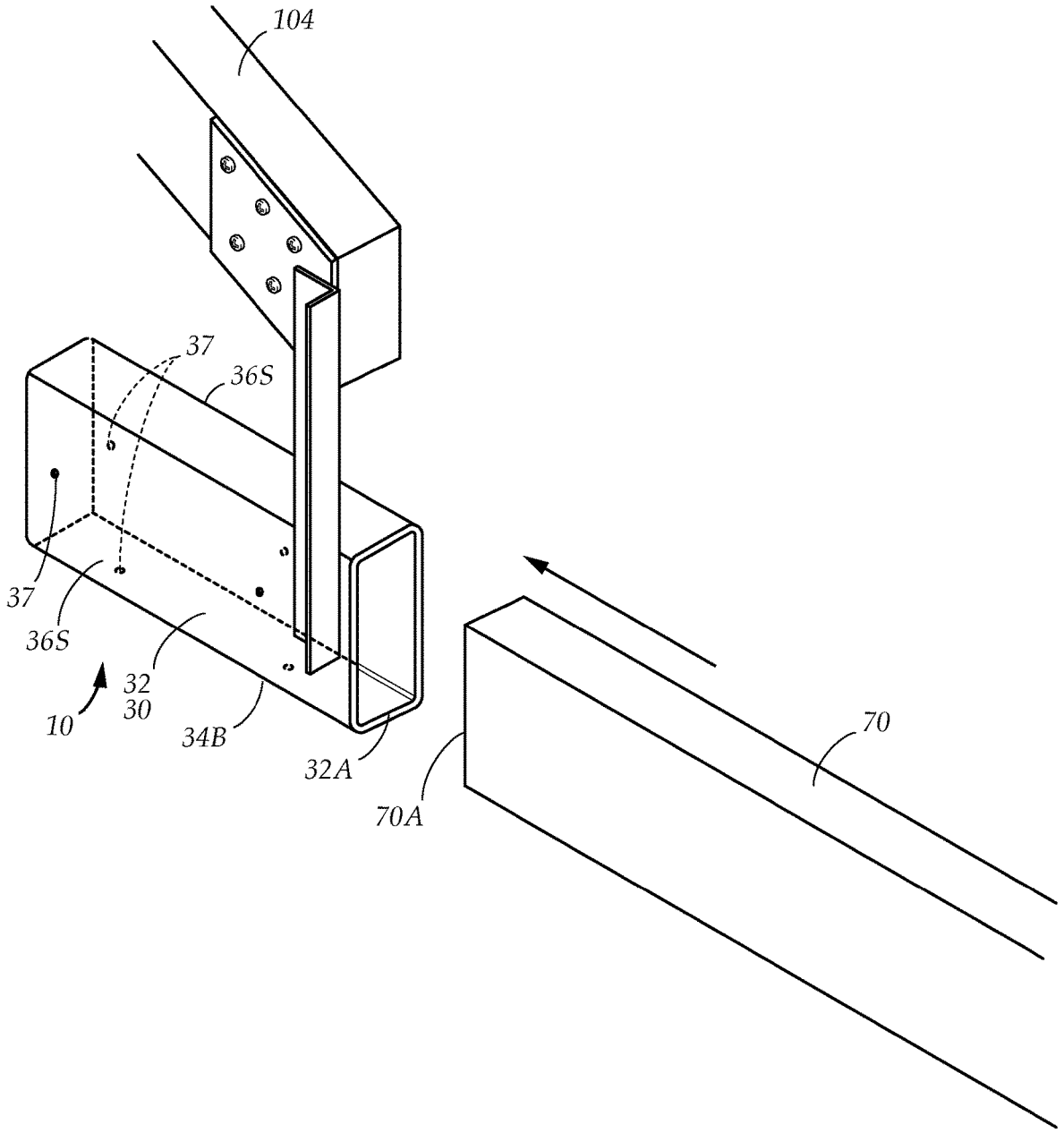
FIG. 16C is a diagrammatic perspective view, illustrating one of the pergola beams about to be inserted into the support assembly.

With the rafter 104 secured to the bracket 10B, the pergola beam 70 maybe inserted into the support assembly 30 as shown in FIG. 16C. In particular, the supported end 70A of the pergola beam 70 is inserted longitudinally into the first open end 32A of the support tube 32 of the support assembly 30. To facilitate a strong structural connection with the pergola beam 70, the side plates 36S and bottom plate 34B of the support assembly 30 have support holes 37 that extend through the side plates 36S. The support holes 37 may be aligned between the side plates 36S to allow fasteners to extend fully therebetween or may be offset.

Figure 16D:
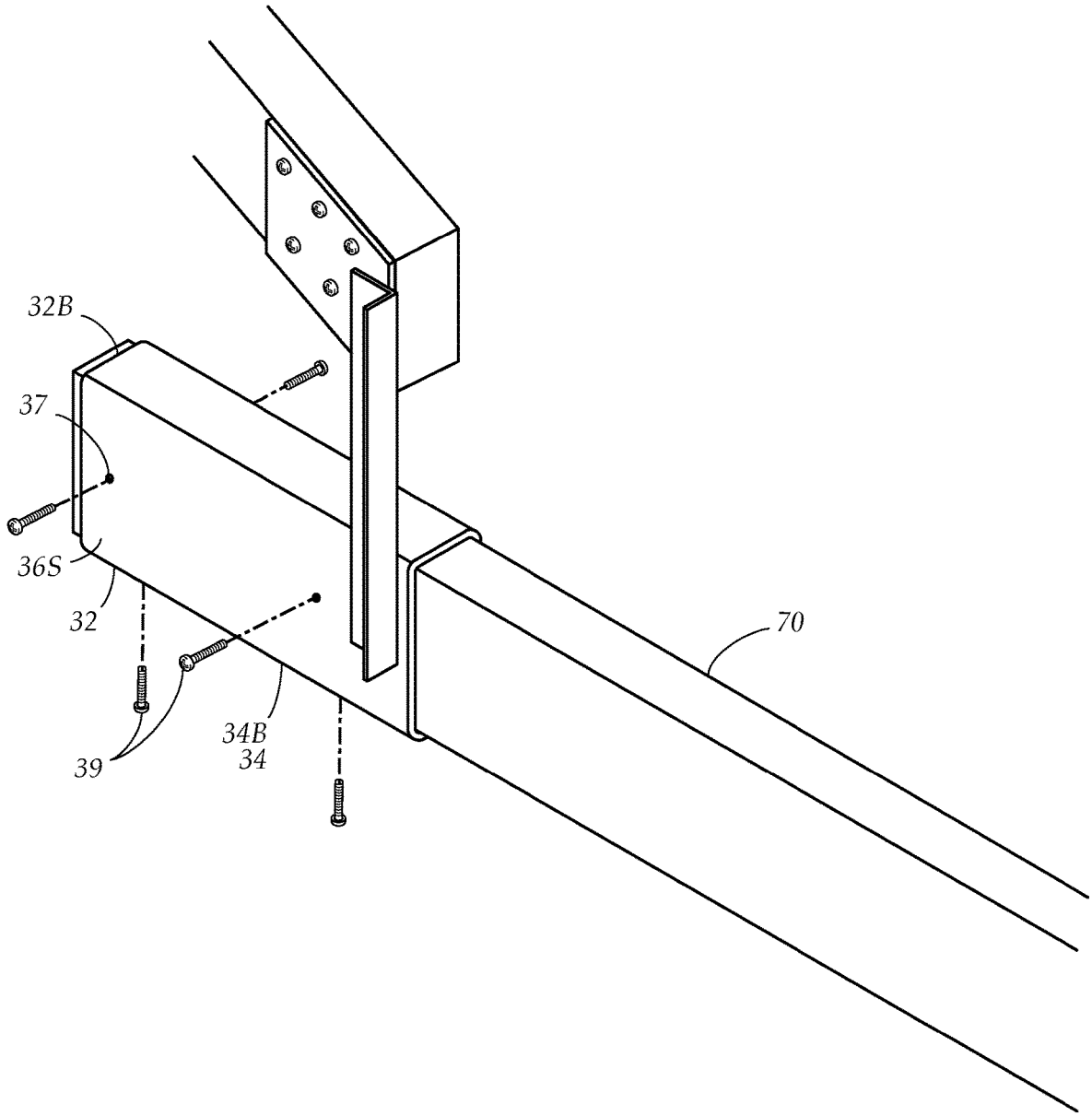
FIG. 16D is a diagrammatic perspective view, showing the pergola beam inserted fully into the support tube of the support assembly, and about to be fastened with support fasteners extending through the support holes.
Figure 16E:
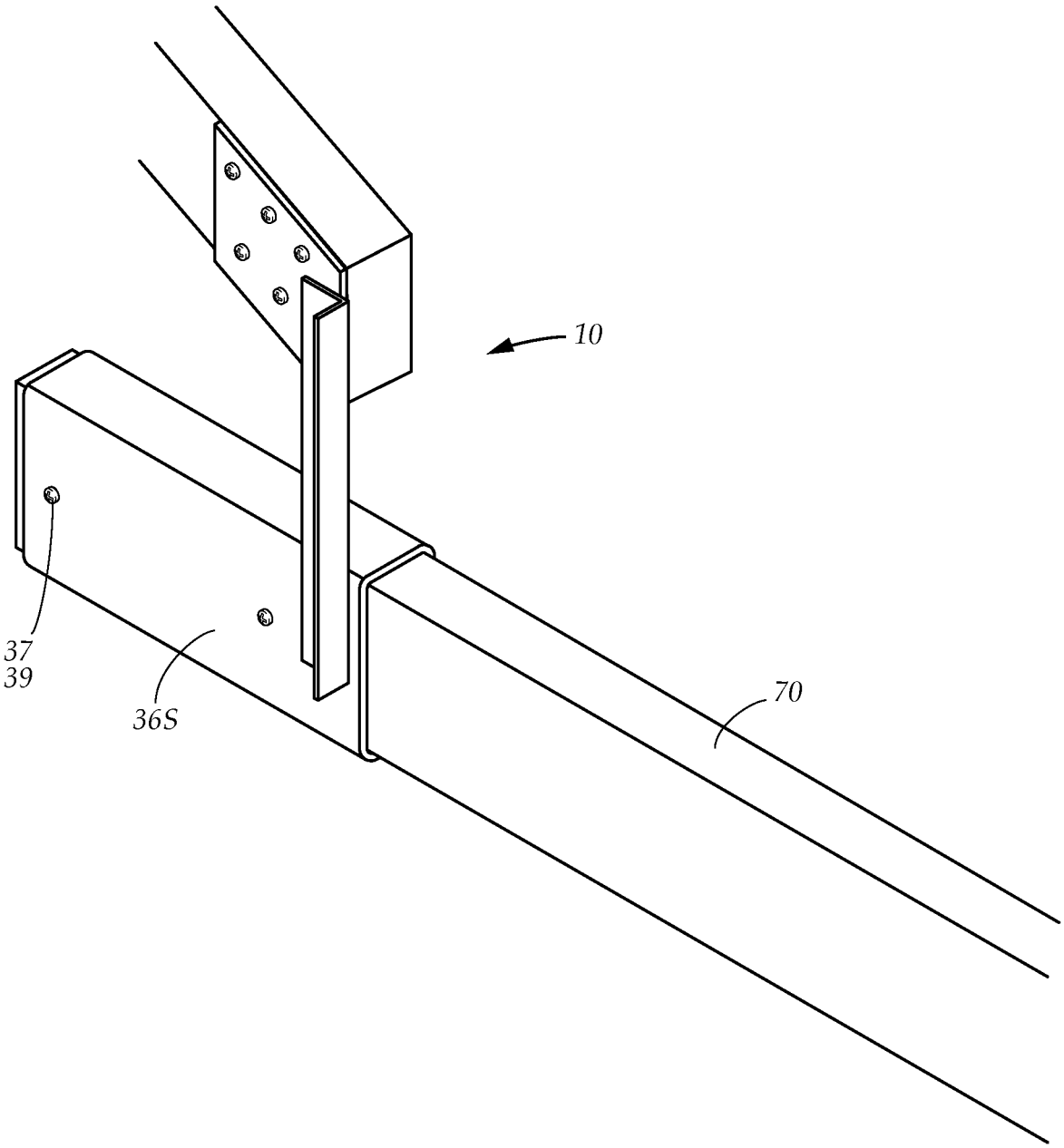
FIG. 16E is a diagrammatic perspective view, showing the pergola beam fully attached within the support assembly and thereby supported and cantilevered from the roof rafter by the bracket.

The pergola beam 70 is extended fully through the support tube 32, and may extend beyond the second open end 32B as shown in FIG. 16D. Support fasteners 39, such as screws or bolts, are inserted through the support holes 37 in the side plate 36S and bottom plate 34B of the support tube 34 and into pergola beam 70 to secure the pergola beam 70 to the bracket 10B as also shown in FIG. 16E.

Figure 17:
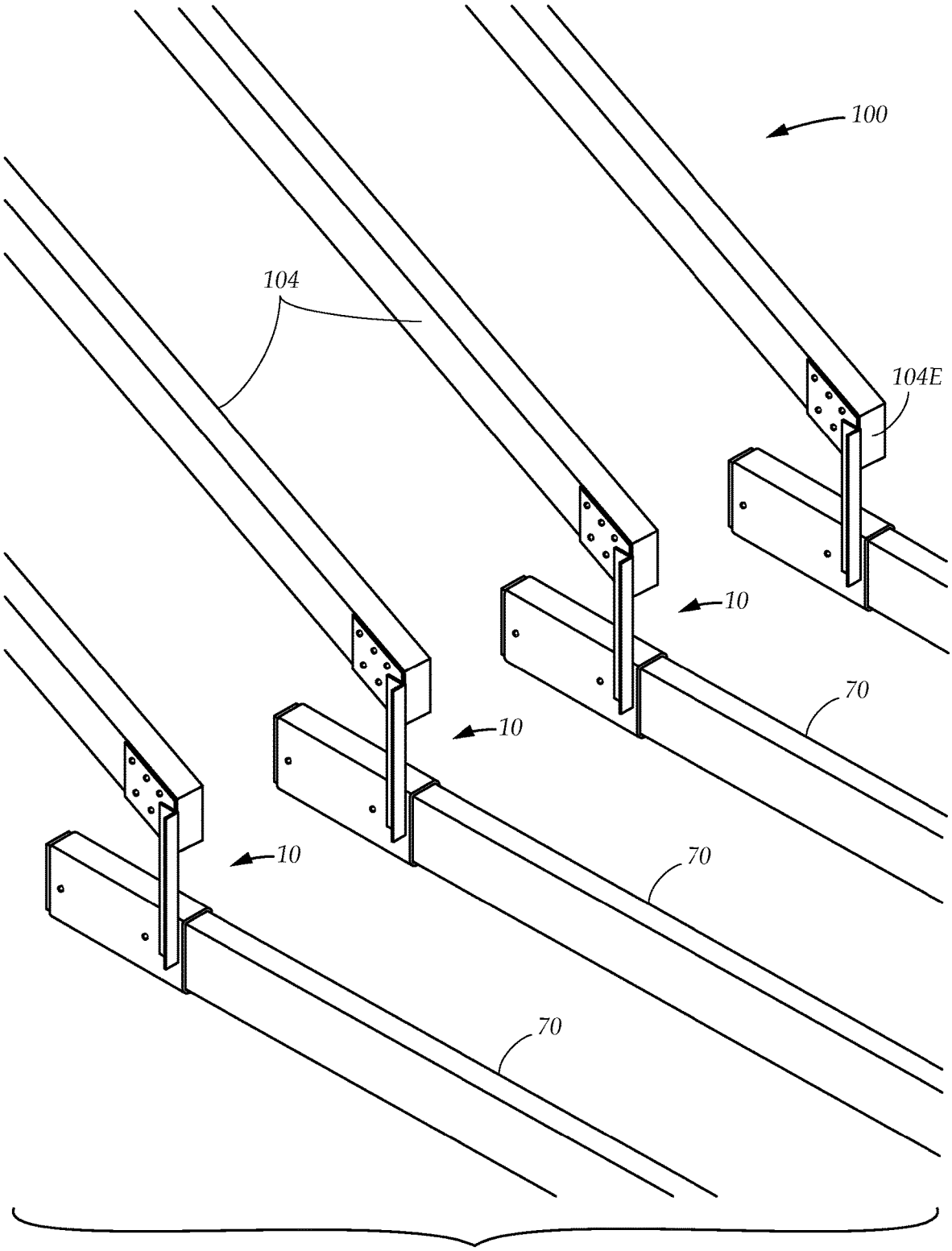
FIG. 17 is a diagrammatic perspective view, showing a cantilevered pergola structure, formed by several pergola beams, extending in parallel, each supported from one of the horizontal rafters by one of the brackets of the further embodiment, as described herein.

FIG. 17 illustrates how, with this embodiment of the bracket 10B, the pergola can be created with numerous pergola beams 70, each pergola beam 70 associated with one of the rafters 104 of the existing structure 100. Each pergola beam 70 having its own bracket 10B that connects it to its associated rafter 104. The pergola beams 70 may have transverse connects, such as for ornamental purposes or to increase the amount of shelter or sun protection. But importantly, no additional vertical support is required as the pergola is effectively cantilevered from the existing structure 100 by using the brackets 10B.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or fdat other orientations) and the spatially relative descriptors used herein interpreted accordingly.

Note that "existing structure" as used herein does not exclude a newly constructed dwelling. It refers to the ability of the bracket system to operate within the constraints of the expected structure of the dwelling and its roof rafters, without requiring modification of the structure, and not to any particular time at which the bracket system is incorporated into the structure.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a bracket system for attaching a cantilevered pergola to a roof rafter. The disclosure is illustrated by example in the drawing figures, and throughout the written description. It should be understood that numerous variations are possible, while adhering to the inventive concept. Such variations are contemplated as being a part of the present disclosure.

What is claimed is:

1. A bracket, for suspending a pergola beam from an existing structure, the existing structure having a vertical wall and horizontal rafters that each have a rafter top, a rafter bottom, and a rafter end that extends beyond the vertical wall over a ground surface, each of the pergola beams having a supported end, the bracket comprising:

A rectangular plate having a top edge, bottom edge, front edge, and rear edge, that is cut along a cut line including a first cut line that is parallel to the top edge of the rectangular plate and a second cut line that extends from the first cut line, parallel to the front edge of the rectangular plate, the rectangular plate has a main region, and a secondary region that is defined by the rear edge of the rectangular plate, the first cut line and second cut line, by a first fold line that extends parallel to the first cut line, and a second fold line that extends parallel to the first cut line, the rectangular plate is bent to form:

a support assembly having a top plate, a first open end, a second open end, and a pair of side plates, the pair of side plates and first open end the support assembly adapted for supporting one of the pergola beams with said pergola beam extending fully between the side plates and between the first open end and the second open end, wherein the support assembly is formed by the secondary region that is separated from the main region along the cut line, orthogonally folded along the first fold line to form the top plate, and then orthogonally folded along the second fold line to form one of the side plates;

a mounting assembly, including a mounting plate, the mounting plate having a top edge, a front edge, an inside surface and an outside surface, the inside surface facing in the direction of the support assembly, the mounting assembly adapted to secure to one of the roof rafters with the roof rafter extending against the inside surface and the rafter top extending parallel to the top edge of the mounting plate; and a connecting assembly connecting and extending between the support assembly and the mounting assembly, the connecting assembly coplanar with the mounting plate and with one of the side plates of the support assembly.

2. The bracket as recited in claim 1, wherein the mounting plate is part of the main region, extending between the first cut line and top edge of the rectangular plate; wherein one of the side plates of the support assembly is part of the main region extending between the first fold line and the bottom edge of the rectangular plate; and wherein the connecting assembly is the main region extending between the mounting plate and support assembly.

3. The bracket as recited in claim 2, further comprising a vertical brace, the vertical brace extending along the front edge of the rectangular plate, alongside the mounting assembly, support assembly, and connecting assembly.

4. The bracket as recited in claim 3, wherein the rectangular plate has a third fold line extending near and parallel to the front edge of the rectangular plate that defines a tertiary region; and wherein the vertical brace is formed by orthogonally folding the tertiary region in a vertical plane in a direction away from the support tube.

5. The bracket as recited in claim 4, wherein the bracket is constructed in a single piece from the rectangular plate.

6. The bracket as recited in claim 5, wherein the mounting plate has mounting holes that extend fully between the inside surface and the outside surface, and further comprise mounting fasteners adapted for extending through the mounting holes and into one of the rafters.

7. The bracket as recited in claim 6, wherein the support assembly has support holes extending through the side plates; and further comprising support fasteners adapted for extending through the support holes and into the pergola beams.

* * * * *